US012565393B2

(12) United States Patent
Iida et al.

(10) Patent No.: US 12,565,393 B2
(45) Date of Patent: Mar. 3, 2026

(54) SHEET CONVEYING DEVICE, AUTOMATIC DOCUMENT FEEDER, AND IMAGE FORMING APPARATUS

(71) Applicants: Yosuke Iida, Kanagawa (JP); Yusuke Nakai, Kanagawa (JP); Chisa Kato, Kanagawa (JP); Hiroyuki Kuno, Kanagawa (JP); Yotaro Mizuno, Kanagawa (JP)

(72) Inventors: Yosuke Iida, Kanagawa (JP); Yusuke Nakai, Kanagawa (JP); Chisa Kato, Kanagawa (JP); Hiroyuki Kuno, Kanagawa (JP); Yotaro Mizuno, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 137 days.

(21) Appl. No.: 18/243,687

(22) Filed: Sep. 8, 2023

(65) Prior Publication Data

US 2024/0083703 A1 Mar. 14, 2024

(30) Foreign Application Priority Data

Sep. 12, 2022 (JP) ..... 2022-144847

(51) Int. Cl.
*B65H 7/06* (2006.01)

(52) U.S. Cl.
CPC ..... *B65H 7/06* (2013.01); *B65H 2515/82* (2013.01); *B65H 2801/06* (2013.01)

(58) Field of Classification Search
CPC ..... B65H 2515/82; B65H 2511/528
See application file for complete search history.

(56) References Cited

U.S. PATENT DOCUMENTS

| | | | | |
|---|---|---|---|---|
| 2009/0152792 | A1 | 6/2009 | Kato et al. | |
| 2009/0230613 | A1 | 9/2009 | Kuno | |
| 2014/0054841 | A1* | 2/2014 | Morikawa | B65H 5/062 271/264 |
| 2015/0336765 | A1 | 11/2015 | Sawada et al. | |
| 2017/0267483 | A1 | 9/2017 | Sawada et al. | |
| 2018/0370751 | A1 | 12/2018 | Sawada et al. | |
| 2020/0071118 | A1 | 3/2020 | Sawada et al. | |
| 2021/0039900 | A1 | 2/2021 | Shimazu et al. | |
| 2021/0087007 | A1 | 3/2021 | Morisaki et al. | |
| 2024/0067484 | A1* | 2/2024 | Nakai | B65H 26/02 |

(Continued)

FOREIGN PATENT DOCUMENTS

| | | |
|---|---|---|
| JP | 2003-141306 A | 5/2003 |
| JP | 2014-058361 A | 4/2014 |

(Continued)

*Primary Examiner* — Howard J Sanders
(74) *Attorney, Agent, or Firm* — XSENSUS LLP

(57) ABSTRACT

A sheet conveying device includes a conveyor, a sound collector, and circuitry. The conveyor conveys a sheet. The conveyor conveys a sheet in a sheet conveyance direction. The sound collector collects an operating sound generated by a conveyance of the sheet. The circuitry is to extract a feature amount of the operating sound collected by the sound collector, and determine, at different positions in the sheet conveyance direction based on the feature amount, whether an abnormal conveyance of the sheet occurs until the sheet is conveyed to a given position in the sheet conveyance direction.

10 Claims, 10 Drawing Sheets

(56) References Cited

U.S. PATENT DOCUMENTS

| | | | | |
|---|---|---|---|---|
| 2024/0294346 | A1* | 9/2024 | Nakai | B65H 7/06 |
| 2024/0300760 | A1* | 9/2024 | Iida | B65H 7/06 |
| 2025/0026595 | A1* | 1/2025 | Kato | B65H 5/062 |
| 2025/0270066 | A1* | 8/2025 | Iida | B65H 29/22 |

FOREIGN PATENT DOCUMENTS

| | | | |
|---|---|---|---|
| JP | 2017-147603 | A | 8/2017 |
| JP | 2019-137549 | A | 8/2019 |
| JP | 2021-181376 | A | 11/2021 |

* cited by examiner

SHEET CONVEYING DEVICE, AUTOMATIC DOCUMENT FEEDER, AND IMAGE FORMING APPARATUS

CROSS-REFERENCE TO RELATED APPLICATION

This patent application is based on and claims priority pursuant to 35 U.S.C. § 119(a) to Japanese Patent Application No. 2022-144847, filed on Sep. 12, 2022, in the Japan Patent Office, the entire disclosure of which is hereby incorporated by reference herein.

BACKGROUND

Technical Field

Embodiments of the present disclosure relate to a sheet conveying device, an automatic document feeder, and an image forming apparatus.

BACKGROUND ART

Various sheet conveying devices are known that include a conveyor to convey a sheet, a sound collector to collect an operating sound generated when the sheet is conveyed, a feature amount extractor to extract the feature amount that has quantitatively expressed the feature of the operating sounds collected by the sound collector, and an abnormal conveyance determination unit to determine whether abnormal conveyance occurs based on the feature amount.

In order to forestall occurrence abnormal conveyance, a sheet conveying device related in the art gives the feature amount that has quantitatively expressed the feature amounts of the operating sounds collected by the sound collector, to a support vector machine, and classifies the feature amounts into three classes that are normal conveyance, document deformation, and document slippage in conveyance, through use of machine learning as index data. When the feature amounts are classified into the document slippage and the document deformation by the support vector machine, it is determined that the conveyance is abnormal conveyance, and stops the conveying operation. When the feature amounts are classified into the document slippage, the conveyor is heated. When the feature amounts are classified into the document deformation, the document feeder cover is opened. Determination of abnormal conveyance is performed once between the start of sheet feeding and the end of separating operation.

SUMMARY

Embodiments of the present disclosure described herein provide a novel sheet conveying device including a conveyor, a sound collector, and circuitry. The conveyor conveys a sheet in a sheet conveyance direction. The sound collector collects an operating sound generated by a conveyance of the sheet. The circuitry is to extract a feature amount of the operating sound collected by the sound collector, and determine, at different positions in the sheet conveyance direction based on the feature amount, whether an abnormal conveyance of the sheet occurs until the sheet is conveyed to a given position in the sheet conveyance direction.

Further, embodiments of the present disclosure described herein provide an automatic document feeder including the above-described sheet conveying device that automatically conveys a document sheet as the sheet to an image reader.

Further, embodiments of the present disclosure described herein provide an image forming apparatus including the above-described automatic document feeder, and an image reader. The automatic document feeder automatically conveys an original document. The image reader reads an image on the original document fed by the automatic document feeder.

Further, embodiments of the present disclosure described herein provide an image forming apparatus including the above-described sheet conveying device, and an image former. The sheet conveying device automatically conveys the sheet. The image former forms an image on the original document fed by the sheet conveying device.

BRIEF DESCRIPTION OF THE SEVERAL VIEWS OF THE DRAWINGS

Exemplary embodiments of this disclosure will be described in detail based on the following figures, wherein.

Figure 1:
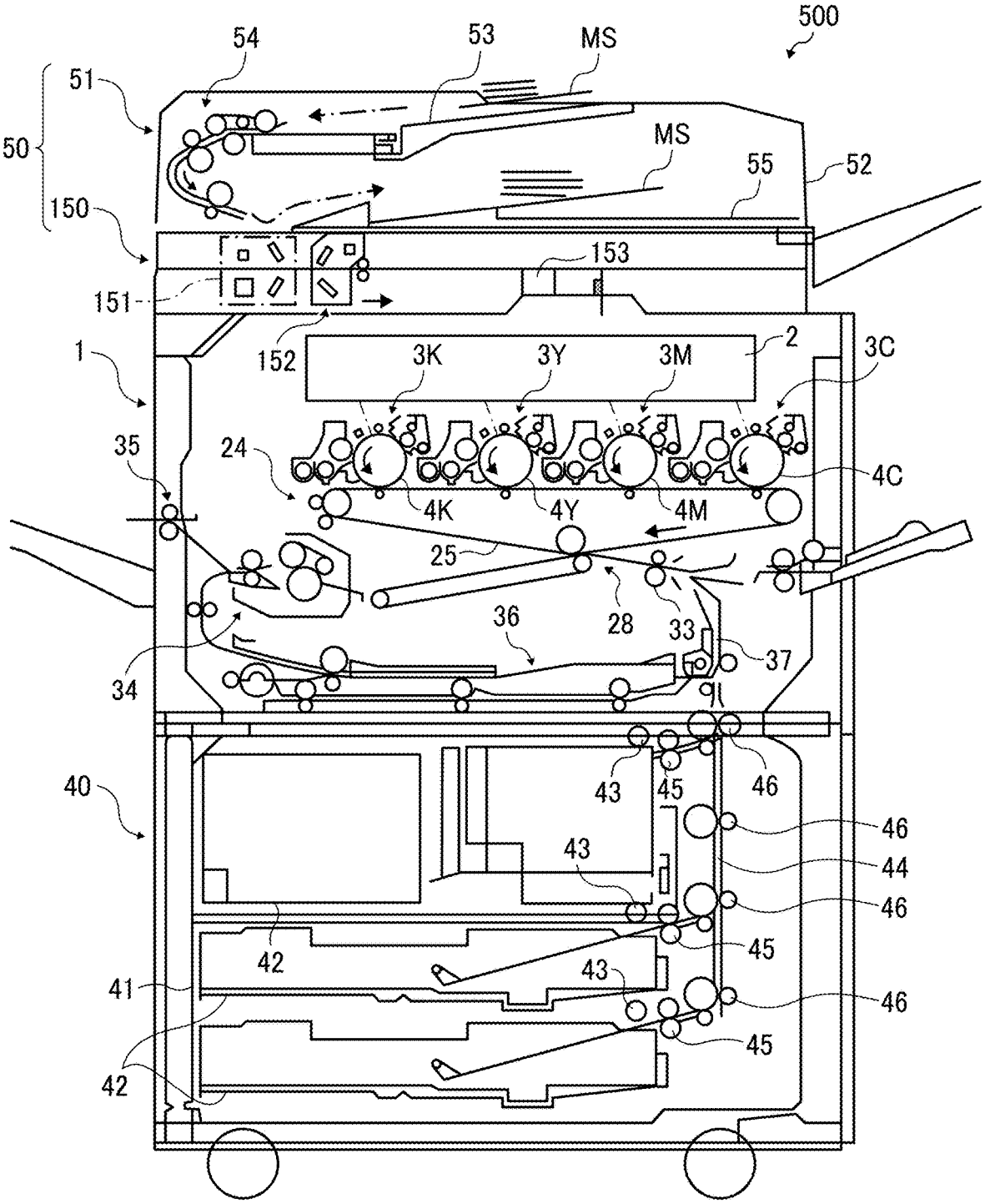
FIG. 1 is a schematic diagram illustrating an inner configuration of a copier as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the present disclosure are described below in detail with reference to the drawings. It is to be understood that an identical or similar reference character is given to identical or corresponding parts throughout the drawings, and redundant descriptions are omitted or simplified below.

Descriptions are given of an electrophotographic image forming apparatus for forming images by electrophotography. In the present disclosure, the electrophotographic image forming apparatus is referred to as an image forming apparatus or a copier.

A description is now given of a copier as an image forming apparatus according to the present embodiment.

FIG. 1 is a diagram illustrating a schematic configuration of a copier 500 serving as an image forming apparatus according to the present embodiment.

The copier 500 includes an image forming unit 1, a blank sheet feeding device 40, and a document reading device 50. The document reading device 50 includes a scanner 150 fixedly mounted on the image forming device 1 and an automatic document feeder (ADF) 51 serving as a document feeder supported by the scanner 150.

The blank sheet feeding device 40 includes a sheet bank 41, sheet feed rollers 43, and sheet separation roller pairs 45. The sheet bank 41 includes multiple sheet trays 42 (three sheet trays 42 in the present embodiment) disposed in a multistage manner. Each of the sheet feed rollers 43 picks up a transfer sheet from the corresponding sheet trays 42. Each of the sheet separation roller pairs 45 separates the transfer sheet from the corresponding sheet tray 42 and feeds the transfer sheet to a sheet conveyance passage 44. The blank sheet feeding device 40 further includes multiple sheet conveyance rollers 46 each of which conveys the transfer sheet toward a sheet conveyance passage 37. Thus, the blank sheet feeding device 40 feeds the transfer sheet stacked on the corresponding sheet tray 42 to the sheet conveyance passage 37 in the image forming device 1.

Figure 2:
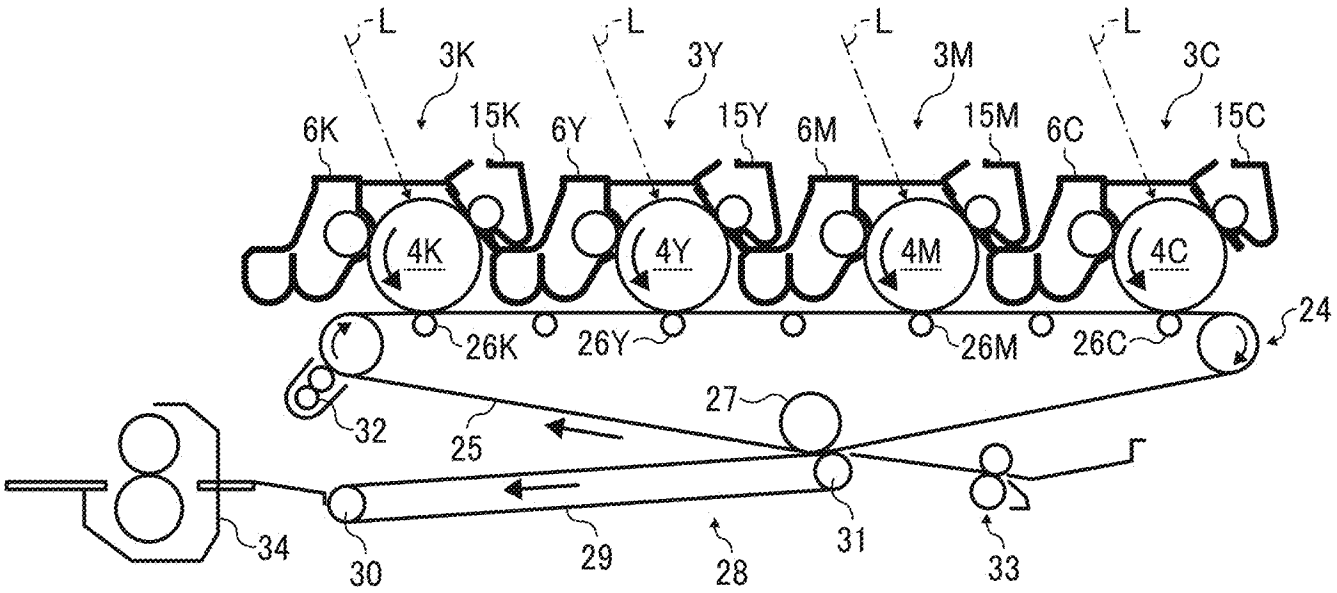
FIG. 2 is a diagram illustrating a partially enlarged configuration of an image forming device included in the copier of FIG. 1.

FIG. 2 is a diagram illustrating a partially enlarged configuration of the image forming device 1 included in the copier 500 of FIG. 1.

As illustrated in FIG. 2, the image forming device 1 includes an optical writing device 2, four process units 3K, 3Y, 3M, and 3C, and a transfer unit 24. The process units 3K, 3Y, 3M, and 3C form a black toner image, a yellow toner image, a magenta toner image, and a cyan toner image, respectively. The image forming device 1 further includes a sheet conveying unit 28, a registration roller pair 33, a fixing device 34, a switchback device 36, and the sheet conveyance passage 37. The optical writing device 2 includes a light source such as a laser diode and a light emitting diode (LED). The light source is disposed in the optical writing device 2. By driving the light source in the optical writing device 2, laser lights L are emitted toward four drum-shaped photoconductors 4K, 4Y, 4M, and 4C to irradiate respective surfaces of the drum-shaped photoconductors 4K, 4Y, 4M, and 4C. Due to this irradiation, electrostatic latent images of respective single colors are formed on the surfaces of the photoconductors 4K, 4Y, 4M, and 4C, which will be developed to visible toner images via a given development process. Suffixes K, Y, M, and C denote colors black, yellow, magenta, and cyan, respectively. To simplify the description, these suffixes may be omitted unless necessary in the following description.

The process units 3K, 3Y, 3M, and 3C also include respective image forming units disposed around each of the photoconductors 4K, 4Y, 4M, and 4C as a single unit supported by a common support member, respectively. The process units 3K, 3Y, 3M, and 3C are detachably attached to the image forming device 1 of the copier 500 serving as an image forming apparatus. The process unit 3 (i.e., the process units 3K, 3Y, 3M, and 3C) includes the photoconductor 4 (i.e., the photoconductors 4K, 4Y, 4M, and 4C) and a developing device 6 (i.e., developing devices 6K, 6Y, 6M, and 6C) that develops an electrostatic latent image formed on a surface of the photoconductor 4 into a visible toner image. The process unit 3 further include a drum cleaning device 15 (i.e., drum cleaning devices 15K, 15Y, 15M, and 15C). The drum cleaning device 15 removes transfer residual toner remaining on the surface of the drum cleaning device 15 after the photoconductor 4 has passed the primary transfer nip region for the photoconductor 4 and cleans the surface of the photoconductor 4. The copier 500 serving as an image forming apparatus is a tandem image forming apparatus in which the four process units 3K, 3Y, 3M, and 3C are aligned in a direction of movement of an intermediate transfer belt 25 as an endless loop.

Figure 3:
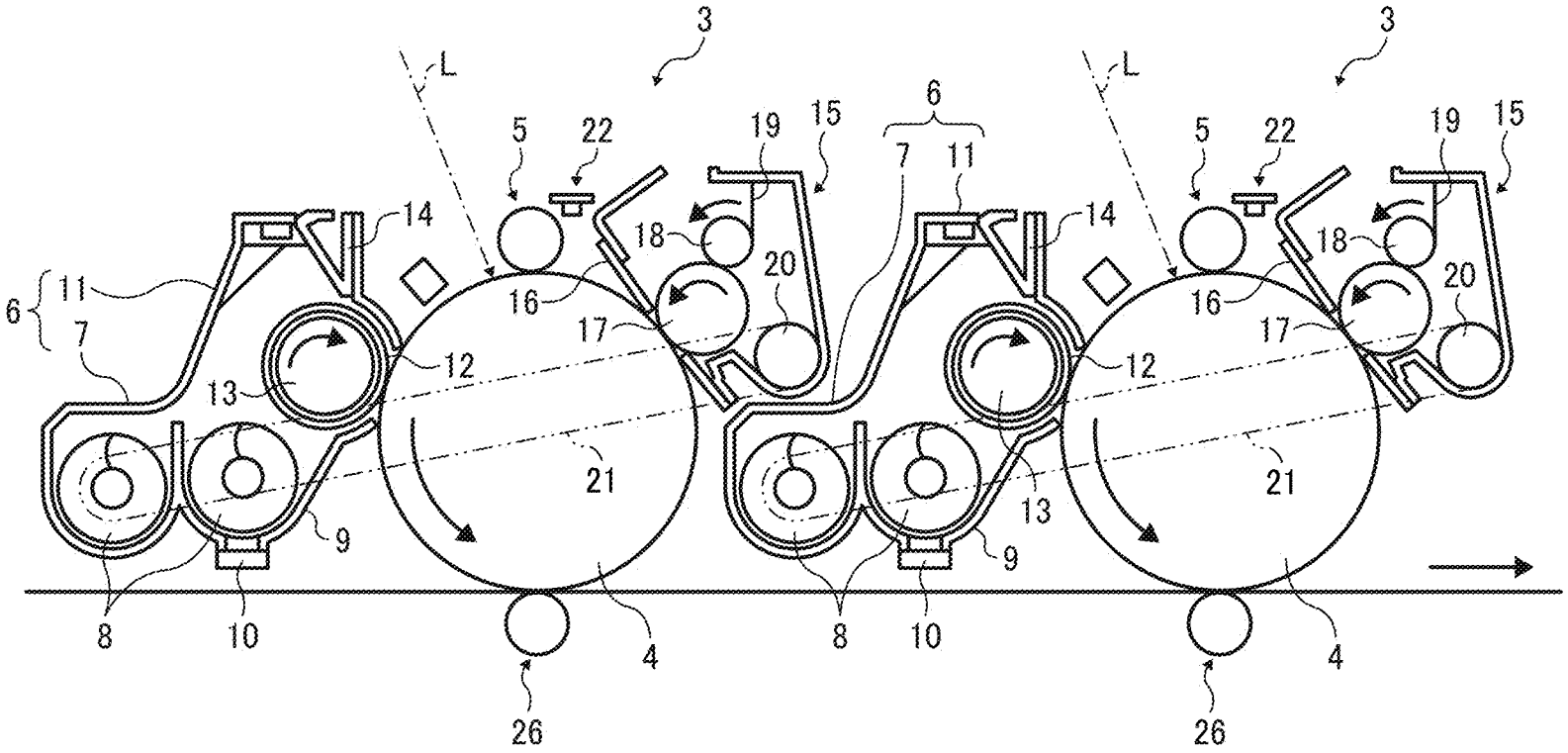
FIG. 3 is an enlarged view of a part of a tandem portion including four process units of the image forming device of FIG. 2.

FIG. 3 is an enlarged view of a part of a tandem portion including the four process units 3K, 3Y, 3M, and 3C.

Since the process units 3K, 3Y, 3M, and 3C have respective configurations substantially identical to each other except the toner colors, the process units 3K, 3Y, 3M, and 3C are also described without suffixes indicating the toner colors, which are K, Y, M, and C in FIG. 3. For example, the process units 3K, 3Y, 3M, and 3C are hereinafter referred to as a "process unit 3" in a single form occasionally. The process unit 3 (i.e., the process units 3K, 3Y, 3M, and 3C) includes the photoconductor 4 (i.e., the photoconductors 4K, 4Y, 4M, and 4C), and a charging device 5, the developing device 6 (i.e., the developing devices 6K, 6Y, 6M, and 6C), the drum cleaning device 15 (i.e., the drum cleaning devices 15K, 15Y, 15M, and 15C), and an electric discharging lamp 22 around the photoconductor 4.

The photoconductor 4 is manufactured by a hollow tube made of aluminum, for example, with a drum shape covered by an organic photoconductive layer having photosensitivity. Each of the photoconductors 3Y, 3M, 3C, and 3K may include an endless belt.

The developing device 6 develops an electrostatic latent image into a visible toner image by a two-component developer including magnetic carrier particles and non-magnetic toner. The two-component developer is now referred to as a "developer". The developing device 6 includes an agitating portion 7 and a development portion 11. The agitating portion 7 stirs the two-component developer accommodated therein and conveys the two-component developer to a development sleeve 12. The development portion 11 supplies the non-magnetic toner, which is included in the two-component developer and held by the development sleeve 12, to the photoconductor 4.

The agitating portion 7 is located at a position lower than the development portion 11 and includes two screw, a partition, a development case 9, and a toner concentration sensor 10. The two transfer screws 8 are disposed in parallel to each other. The partition is disposed between the two transfer screws 8. The development case 9 has an opening or a slot to face the photoconductor 4. The toner concentration sensor 10 is disposed on the bottom of the development case 9.

The development portion 11 includes the development sleeve 12, a magnetic roller 13, and a doctor blade 14. The development sleeve 12 faces the photoconductor 4 through the opening (or the slot) of the development case 9. The magnetic roller 13 is fixedly or non-rotatably disposed inside the development sleeve 12. The doctor blade 14 is disposed adjacent to the development sleeve 12 and the leading end of the doctor blade 14 is disposed close to the development sleeve 12. The development sleeve 12 has a non-magnetic, rotatable tubular body. The magnetic roller 13 has multiple magnetic poles arranged in the order in a rotation direction of the development sleeve 12, starting from an opposed position to the doctor blade 14. Each of these magnetic poles applies a magnetic force at a predetermined position in the rotation direction of the development sleeve 12, with respect to the two-component developer supplied on the development sleeve 12. With this action of the magnetic roller 13, the two-component developer that is conveyed from the agitating portion 7 is attracted and attached to the surface of the development sleeve 12 and a magnetic brush of toner is formed along the lines of the magnetic force on the surface of the development sleeve 12.

In accordance with rotation of the development sleeve 12, the magnetic brush is regulated to have an appropriate layer thickness when passing by the opposed position to the doctor blade 14. Then, the magnetic brush is moved to a development region facing the photoconductor 4. Due to a difference of potentials between a development bias that is applied to the development sleeve 12 and an electrostatic latent image formed on the surface of the photoconductor 4, the toner is transferred onto the electrostatic latent image, so that the electrostatic latent image is developed into a visible toner image. Further, after returning into the development portion 11 again along the rotation of the development sleeve 12 then leaving from the surface of the development sleeve 12 due to repulsion of the magnetic field formed between the magnetic poles of the magnetic roller 13, the two-component developer in a form of the magnetic brush is returned to the agitating portion 7. An appropriate amount of toner is supplied to the two-component developer in the agitating portion 7 based on a result or results detected by the toner concentration sensor 10. Alternative to the two-component developer, the developing device 6 according to the present embodiment may employ one-component developer that does not include magnetic carriers.

In the present embodiment, the drum cleaning device 15 employs a method of pressing a cleaning blade 16 made of a polyurethane rubber pressed against the photoconductor 4. However, in some embodiments, any other suitable cleaning method may be used.

The fur brush 17 according to the present embodiment is provided in order to increase cleanability. The fur brush 17 is a conductive member and the outer circumferential surface of the fur brush 17 slidably contacts the photoconductor 4. The fur brush 17 according to the present embodiment is rotatable in a direction indicated by arrow in FIG. 4. The fur brush 17 also functions as an applier that scrapes a solid lubricant to obtain fine powder of lubricant and applies the scraped fine powder to the surface of the photoconductor 4. The electric field roller 18 is a metallic member that applies a bias to the fur brush 17. The electric field roller 18 is disposed rotatably in a direction indicated by arrow in FIG. 3. The scraper 19 has a leading end that is pressed against the electric field roller 18. The toner removed from the photoconductor 4 and attached to the fur brush 17 is transferred onto the electric field roller 18 that contacts the fur brush 17 in a counter direction to be applied with a bias while the electric field roller 18 is rotating. After being scraped and removed from the electric field roller 18 by the scraper 19, the toner falls onto the collection screw 20. The collection screw 20 conveys the toner collected from the surface of the photoconductor 4 toward an end portion of the drum cleaning device 15 in a direction perpendicular to the drawing sheet, and transfers the collected toner to an external toner recycling transfer device 21. The external toner recycling transfer device 21 sends the collected toner to the developing device 6 for recycling.

The electric discharging lamp 22 removes residual electric charge remaining on the surface of the photoconductor 4 by photo irradiation. After such residual electric charge is removed, the electrically discharged surface of the photoconductor 4 is uniformly charged by the charging device 5 again and then optically irradiated by the optical writing unit 2. In the copier 500 serving as an image forming apparatus according to the present embodiment, the charging device 5 is a charging roller that is applied with charging bias and rotates while contacting the photoconductor 4. However, in some embodiments, the charging device 5 may be a scorotron charger that performs a charging process on the photoconductor 4 in non-contact with the photoconductor 4.

According to the above-described operations with the configuration illustrated in FIG. 2, black (K), yellow (Y), magenta (M), and cyan (C) toner images are formed on the photoconductors 4K, 4Y, 4M, and 4C of the process units 3K, 3Y, 3M, and 3C, respectively.

The transfer unit 24 is disposed below the process units 3K, 3Y, 3M, and 3C, as illustrated in FIG. 2. The transfer unit 24 endlessly moves the intermediate transfer belt 25 in the clockwise direction in FIG. 2 while the intermediate transfer belt 25 is stretched by and would around multiple rollers and is in contact with the photoconductors 4K, 4Y, 4M, and 4C. By so doing, respective primary transfer nip regions for forming black, yellow, magenta, and cyan images are formed between the photoconductors 4K, 4Y, 4M, and 4C and the intermediate transfer belt 25 in contact with each other. In proximity to each of the primary transfer nip regions for black, yellow, magenta, and cyan images, the primary transfer rollers 26 (i.e., the primary transfer rollers 26K, 26Y, 26M, and 26C) are disposed in contact with the inner loop of the intermediate transfer belt 25 to press the intermediate transfer belt 25 against the photoconductors 4 (i.e., the photoconductors 4K, 4Y, 4M, and 4C), respectively. A primary transfer bias is applied by respective transfer bias power supplies to the primary transfer rollers 26K, 26Y, 26M, and 26C. Consequently, respective primary transfer electric fields are generated in the primary transfer nip regions to electrostatically transfer respective toner images formed on the photoconductors 4K, 4Y, 4M, and 4C onto the intermediate transfer belt 25. As the intermediate transfer belt 25 passes through the primary transfer nip regions along the endless rotation in the clockwise direction in FIG. 2, the black, yellow, magenta, and cyan toner images are sequentially transferred at the primary transfer nip regions and overlaid onto an outer circumferential surface of the intermediate transfer belt 25. Due to the primary transfer of the toner images, a four-color composite toner image (referred to as a four-color toner image) is formed on the surface of the intermediate transfer belt 25.

The sheet conveying unit 28 is disposed below the transfer unit 24 in FIG. 2. The sheet conveying unit 28 includes a sheet transfer belt 29, a sheet transfer belt drive roller 30, and a secondary transfer roller 31. The sheet transfer belt 29 is an endless belt that is wound around the sheet transfer belt drive roller 30 and the secondary transfer roller 31 and rotates in a direction indicated by arrow in FIG. 2. As illustrated in FIG. 2, the intermediate transfer belt 25 and the sheet transfer belt 29 are sandwiched between the secondary transfer roller 31 and a lower tension roller 27 of the transfer unit 24. According to this configuration, a secondary transfer nip region is formed between the surface of the intermediate transfer belt and the surface of the sheet transfer belt 29 contacting with each other. A secondary transfer bias is applied by a transfer bias power source to the secondary transfer roller 31. On the other hand, the lower tension roller 27 of the transfer unit 24 is electrically grounded. By so doing, a secondary transfer electric field is formed in the secondary transfer nip region.

The registration roller pair 33 is disposed on the right side of the secondary transfer nip region in FIG. 2. The registration roller pair 33 nips the transfer sheet P between the rollers and conveys the transfer sheet P to the secondary transfer nip region in synchronization with arrival of the four-color toner image formed on the intermediate transfer belt 25 so as to further convey the transfer sheet P toward the secondary transfer nip region. In the secondary transfer nip region, the four-color toner image formed on the intermediate transfer belt 25 is transferred onto the transfer sheet P due to the secondary transfer electric field and a nip pressure. At this time, the four-color toner image is combined with white color of the transfer sheet P to make a full-color toner image. After passing through the secondary transfer nip region, the transfer sheet P having the full-color toner image on the surface is separated from the intermediate transfer belt 25. Then, while being held on the surface of the sheet transfer belt 29, the transfer sheet P is conveyed to the fixing device 34 along with endless rotation of the sheet transfer belt 29 in the direction indicated by arrow in FIG. 2.

Residual toner that has not been transferred onto the transfer sheet P in the secondary transfer nip region remains on the surface of the intermediate transfer belt 25 after the intermediate transfer belt 25 has passed through the secondary transfer nip region. The residual toner is scraped and removed from the surface of the intermediate transfer belt 25 by a belt cleaning device 32 that is disposed in contact with the surface of the intermediate transfer belt 25.

The transfer sheet P is conveyed to the fixing device 34. The fixing device 34 fixes the full-color toner image to the transfer sheet P by application of heat and pressure. Then, the transfer sheet P is conveyed from the fixing device 34 to the sheet ejection roller pair 35 (see FIG. 1) to be ejected to the outside of the copier 500.

As illustrated in FIG. 1, the switchback device 36 is disposed below the sheet conveying unit 28 and the fixing device 34. As a result of the above-described operation, after the image fixing operation is performed on one side or the surface of the transfer sheet P, a separator switches the direction of conveyance of the transfer sheet P. Specifically, the direction of conveyance of the transfer sheet P is switched to a passage to a transfer reversal device by the separator. When the transfer sheet P is conveyed to the transfer reversal device, the transfer sheet P is reversed to enter the secondary transfer nip region of the copier 500 again. In the copier 500, a toner image is secondarily transferred onto the other side or a back face of the transfer sheet P so that the secondary transfer process and the fixing process are executed. Then, the transfer sheet P is ejected onto the ejection tray.

Figure 4:
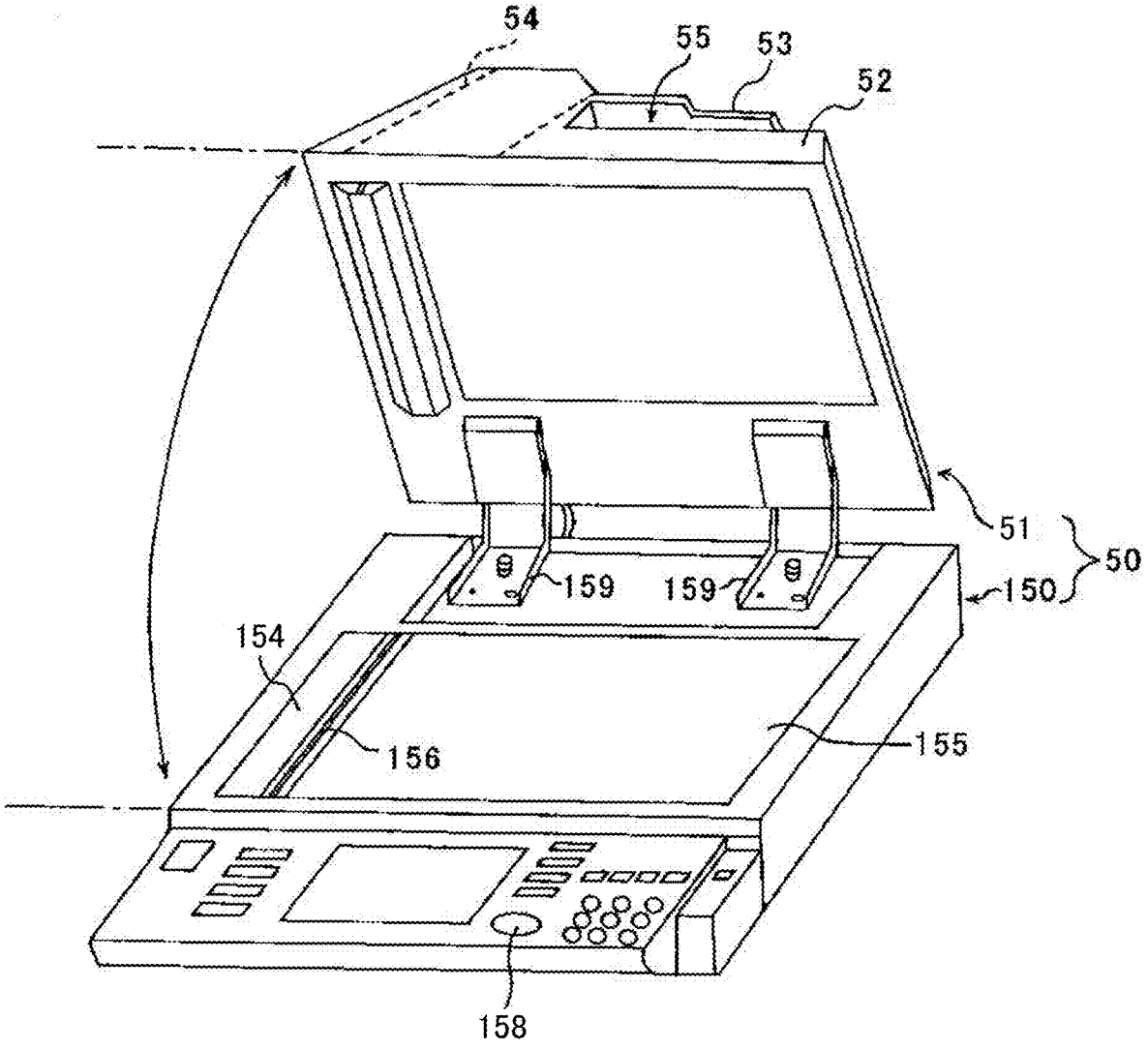
FIG. 4 is a perspective view of a scanner and an automatic document feeder of the copier of FIG. 1.

FIG. 4 is a perspective view of the scanner 150 and the ADF 51 of the copier of FIG. 1.

The scanner 150 is fixedly mounted on the image forming device 1 and includes a first fixed reading unit 151 serving as a first face reader, and a movable scanning unit 152 serving as a first face reader.

The movable scanning unit 152 serving as a first face reader is disposed immediately below a second exposure glass 155 (see FIG. 4) that is fixedly mounted on an upper wall of a casing of the scanner 150 so as to contact an original document MS. The movable scanning unit 152 includes a light source and optical process units such as multiple reflection mirrors, so that these optical units can move in a horizontal direction (in other words, left and right directions) in FIG. 1. In the course of moving the optical components from left to right in FIG. 1, the light source emits the light. After a surface of the original document MS placed on the second exposure glass 155 reflects light, the reflected light is further reflected on multiple reflection mirrors until an image reading sensor 153 that is fixed to the scanner 150 receives the reflected light.

The first fixed reading unit 151 serving as a first face reader is disposed immediately below a first exposure glass 154 (see FIG. 4) that is fixedly mounted on the upper wall of the casing of the scanner 150, so that the first exposure glass 154 contacts the original document MS. When the original document MS that is conveyed by the ADF 51 that will be described below passes over the first exposure glass 154, the light source emits light. After a document face of the original document MS sequentially reflects the light emitted from the light source, the reflected light is further reflected on multiple reflection mirrors until the image reading sensor 153 receives the reflected light. By so doing, the first face of the original document MS is scanned without moving the optical components such as the light source and the multiple reflection mirrors.

Further, the scanner 150 also includes a contact image sensor 95 (see FIG. 5) that reads the second side of the original document MS. The contact image sensor 95 is described below.

The ADF 51 that is disposed on the scanner 150 includes a body cover 52, a document loading tray 53, a document conveyance unit 54, and a document stacker 55. The body cover 52 holds and supports the document loading tray 53, the document conveyance unit 54, and the document stacker 55. The document loading tray 53 loads the original document MS to be read. The document conveyance unit 54 conveys the original document MS. The document stacker 55 receives and stacks the original document MS after the original document MS is read. As illustrated in FIG. 4, hinges 159 each being fixed to the scanner 150 rotatably support the scanner in the upward and downward directions. With the rotation of the ADF 51 in the upward and downward directions, the ADF 51 works as an opening door, so that the first exposure glass 154 and the second exposure glass 155 on the upper face of the scanner 150 are exposed while the ADF 51 is open.

In a case of the one-sided bound documents such as a book of a document bundle bounded on one-side, the original documents MS cannot be separated one by one. For this reason, the original documents MS cannot be conveyed by the ADF 51. When reading the one-sided bound documents, the ADF 51 is opened as illustrated in FIG. 4. Then, the one-sided bound documents opened are placed on the second exposure glass 155 with a page to be read facing down. Then, the scanner 150 causes the movable scanning unit 152 to read the image on the page of the one-sided bound documents placed facedown.

On the other hand, when the original documents MS are in a form of a document bundle of simply accumulated individual original documents MS, the original documents MS are sequentially read by the first fixed reading unit 151 in the scanner 150 or the contact image sensor 95 in the ADF 51 while the ADF 51 automatically conveys the original documents MS one by one. In this case, a copy start button is pressed after the bundle of original documents is set on the document loading tray 53 of the ADF 51. Then, the ADF 51 starts conveyance of the original documents MS that is a bundle of original documents stacked on the document loading tray 53 to convey each original document MS sequentially from top of the bundle of original documents MS to the document stacker 55. In the course of this conveyance of the original documents MS, immediately after the original document MS is reversed, the original document MS is caused to pass immediately above the first fixed reading unit 151 of the scanner 150.

At this time, the image on the first face of the original document MS is read by the first fixed reading unit 151 of the scanner 150.

Figure 5:
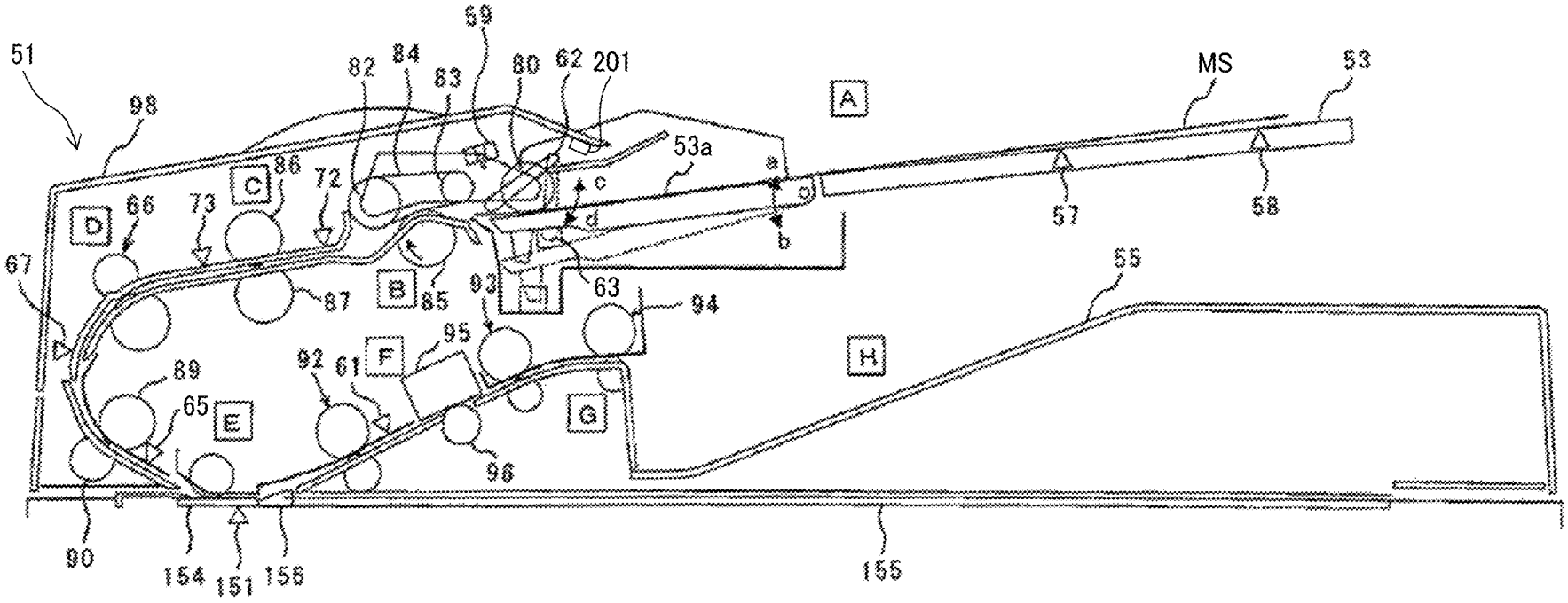
FIG. 5 is an enlarged view of the automatic document feeder and the upper part of the scanner.

FIG. 5 is a diagram illustrating an enlarged part of the configuration of the ADF 51 and the upper part of the scanner 150.

Figure 6:
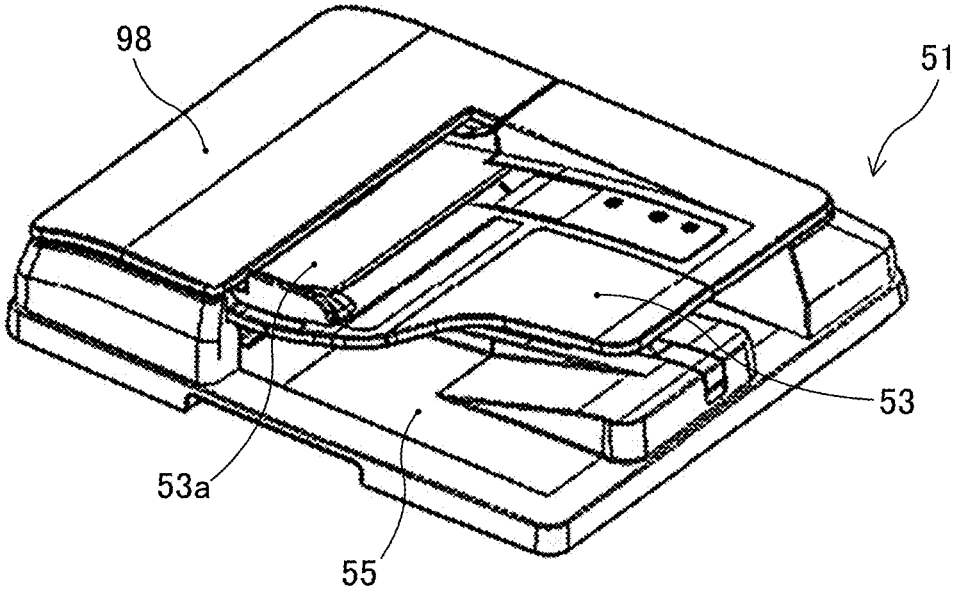
FIG. 6 is a perspective view of the automatic document feeder.

FIG. 6 is a perspective view of the ADF 51.

Figure 7:
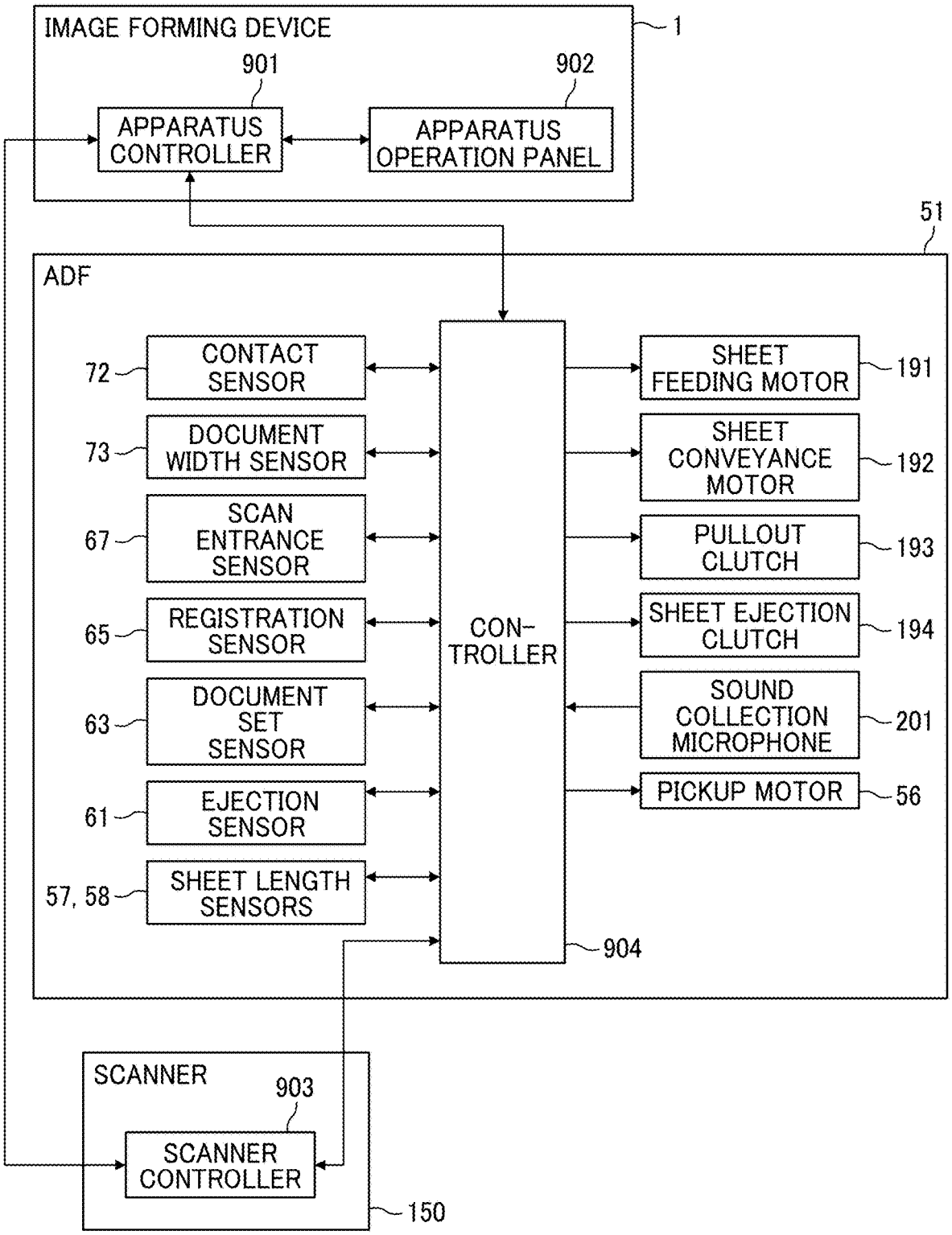
FIG. 7 is a block diagram illustrating a part of an electric circuit of the automatic document feeder and the scanner.

FIG. 7 is a block diagram illustrating a part of an electric circuit of the ADF 51 and the scanner 150.

As illustrated in FIG. 5, the ADF 51 according to the present embodiment includes a document setting part A, a document separating and feeding part B, a registration part C, a document turning part D, a first reading and conveying part E, a second reading and conveying part F, a document ejecting part G, and a document stacking part H.

As illustrated in FIG. 7, the ADF 51 includes an ADF controller 904 provided with, for example, an application specific integrated circuit (ASIC) to control various components and sensors in the ADF 51. The ADF controller 904 is connected to a registration sensor 65, a document set sensor 63, a document ejection sensor 61, a document contact sensor 72, a document width sensor 73, a scan entrance sensor 67, a first sheet length sensor 57, and a second sheet length sensor 58, as illustrated in FIG. 6. The ADF controller 904 is further connected to, for example, a sheet feeding motor 191, a sheet conveyance motor 192, a pullout clutch 193, a sheet ejection clutch 194, and a pickup motor 56. The ADF controller 904 is further connected to a sound collection microphone 201 serving as a sound collector. The sound collection microphone 201 collects sound occurring when the original document MS is conveyed.

As illustrated in FIG. 7, the scanner 150 includes a scanner controller 903 including, for example, a central processing unit (CPU) and a random access memory (RAM). With the scanner controller 903, various components and sensors in the scanner 150 can be controlled. Further, the scanner controller 903 is connected to the ADF controller 904 of the ADF 51 via the interface (I/F). The scanner controller 903 may indirectly control the various components and sensors in the ADF 51 via the ADF controller 904.

In FIG. 5, the document setting part A has the document loading tray 53 on which a bundle of original documents MS is set. The document separating and feeding part B separates the original documents MS one by one from the bundle of original documents MS set on the document loading tray 53 in the document setting part A to feed the separated original document MS. Further, in the registration part C, the original document MS fed from the document separating and conveying part B temporarily contacts the pullout driven roller 86 and the pullout drive roller 87 to be aligned and fed again. The document turning part D has a conveyance passage curved in a C-shape, and turns the original document MS to be conveyed in the curved conveyance passage so as to reverse the original document MS upside down while turning the original document MS. Then, in the first reading and conveying part E, the first fixed reading unit 151 disposed in the scanner 150 below the first exposure glass 154 as illustrated in FIG. 1 reads the first face of the original document MS while the original document MS is being conveyed on the first exposure glass 154. Further, in the second reading and conveying part F, the contact image sensor 95 reads the second face of the original document MS while the original document MS is conveyed under the contact image sensor 95. After the images on both sides of the original document MS, the original document MS is conveyed in the document ejecting part G to be ejected toward the document stacking part H. In the document stacking part H, the document stacker 55 stacks the original documents MS.

The original document MS is set in the document setting part A with the leading end of the original document MS placed on the movable document table 53*a* serving as a sheet tray pivotable in the directions indicated by arrows "a" and "b" in FIG. 5 depending on the thicknesses of a bundle of the original documents MS and the trailing end of the original document MS placed on the document loading tray 53. At this time, the side guides of the document loading tray 53 contact both lateral side ends of the original document MS in the width direction (i.e., the direction orthogonal to the drawing sheet) to adjust the position of the original document MS in the width direction. The original documents MS thus set push up a lever 62 that is pivotably disposed above the movable document table 53*a*. Along with this movement of the original documents MS, the document set sensor 63 detects the setting of the original documents MS, and transmits the detection signal to the ADF controller 904 (see FIG. 7). The detection signal is then transmitted from the ADF controller 904 to the scanner controller 903 via the I/F.

The first sheet length sensor 57 and the second sheet length sensor 58 are held on the document loading tray 53. Each of the first sheet length sensor 57 and the second sheet length sensor 58 includes a reflective photosensor or an actuator-type sensor for detecting the length of the original document MS in the sheet conveyance direction. The length of the original document MS in the sheet conveyance direction is detected with the first sheet length sensor 57 and the second sheet length sensor 58.

The pickup roller 80 is supported by the cam mechanism to be movable in the vertical direction (i.e., the directions indicated by arrows "c" and "d" in FIG. 5) and is disposed above the bundle of original documents MS stacked on the movable document table 53*a*. The cam mechanism is driven by the pickup motor 56 to move the pickup roller 80 in the vertical direction. As the pickup roller 80 moves upward, the movable document table 53*a* rotates in the direction indicated by arrow "a" in FIG. 5, so that the pickup roller 80 is brought to contact the uppermost original document MS placed on top of the bundle of original documents MS. As the movable document table 53*a* further moves upward, a table lifting sensor 59 detects that the movable document table 53*a* moves up to the maximum height. In response to this detection, the pickup motor 56 stops driving to stop the movable document table 53*a* from moving up.

The apparatus control panel 902 including, for example, a numeric keypad and a display provided in the housing of the copier 500 is operated by an operator to perform a key operation for setting a reading mode indicating a double-sided reading mode or a single-sided reading mode and a pressing operation of a copy start key. In other words, the apparatus control panel 902 functions as a mode information acquisition unit that acquires information indicating whether the reading mode is the double-sided reading mode or the single-sided reading mode. The reading mode includes a thin paper mode for reading thin paper and a mixed mode in which original documents MS of different sizes are mixed and conveyed. The operator can set the thin paper mode or the mixed mode by the key operation on the apparatus control panel 902 by the operator. In the thin paper mode or the mixed mode, the original document MS is conveyed at a conveyance speed of the original document MS totally slower than the normal reading mode.

As the copy start button 158 is pressed down, a document feeding signal is sent from an apparatus controller 901 to the ADF controller 904 of the ADF 51 via the I/F. In response to the sending of the document feeding signal, the pickup roller 80 is rotated along with the forward rotation of the sheet feeding motor 191, so that the original documents MS on the movable document table 53*a* are fed from the movable document table 53*a*.

The setting of the double-sided reading mode or the single-sided reading mode collectively covers the whole original documents MS stacked on the movable document table 53*a*. To be more specific, when the double-sided reading mode or the single-sided reading mode is set, both sides or a single-side of the whole original documents MS stacked on the movable document table 53*a* can be read.

In addition, individual reading mode setting can be performed on separate ones of the original documents MS. For example, the double-sided reading mode can be applied to the first and 10th original documents MS while the single-sided reading mode can be applied to the other original documents MS.

The original document MS fed by the pickup roller 80 enters the document separating and feeding part B to be fed to the contact position with the sheet feed belt 84. The sheet feed belt 84 is wound and stretched by a drive roller 82 and a driven roller 83 to be endlessly moved in the clockwise direction in FIG. 5 by rotation of the drive roller 82 along with the forward rotation of the sheet feeding motor 191. A separation roller 85 is in contact with the lower stretched face of the sheet feed belt 84 to be rotated in the clockwise direction in FIG. 5 along with the forward rotation of the sheet feeding motor 191. At the contact portion, the sheet feed belt 84 is rotated so that the surface of the sheet feed belt 84 moves in the sheet conveyance direction.

By contrast, the separation roller 85 is in contact with the sheet feed belt 84 with a given pressure. When the separation roller 85 directly contacts the sheet feed belt 84 or a single original document MS is nipped in the contact portion, the separation roller 85 is rotated with rotation of the sheet feed belt 84 or movement of the original document MS. However, when multiple original documents MS are nipped in the contact portion, the force of the separation roller 85 to be rotated with rotation of the sheet feed belt 84 or movement of the original document MS is lower than the torque of a torque limiter. For this reason, the separation roller 85 is rotated in the clockwise direction that is opposite to a direction in which the separation roller 85 is rotated. As a result, the separation roller 85 applies the force of movement in the direction opposite to the sheet conveyance direction, to the original documents MS under the uppermost original document MS, so that the uppermost original document MS is separated from the multiple original documents MS under the uppermost original document MS.

The original document MS is separated from the other original documents MS through the operations of the sheet feed belt 84 and the separation roller 85, and enters the registration part C. Then, the leading end of the original document MS is detected when the original document MS passes directly under the document contact sensor 72. At this time, the pickup roller 80 receiving the driving force of the sheet feeding motor 191 is still rotating. However, as the pickup roller 80 is separated from the original document MS due to descendance of the movable document table 53*a*, the original document MS is conveyed only by an endless moving force of the sheet feed belt 84. Then, the endless movement of the sheet feed belt 84 is continued for a given time from the timing at which the leading end of the original document MS is detected by the document contact sensor 72. Then, the leading end of the original document MS contacts the contact portion of the pullout driven roller 86 and the pullout drive roller 87 that rotates while contacting the pullout driven roller 86. While the leading end of the original document MS contacts the contact portion of the pullout driven roller 86 and the pullout drive roller 87, the trailing end of the original document MS is conveyed in the sheet conveyance direction. By so doing, the leading end of the original document MS is positioned at the contact portion while the original document MS is bent by a given amount. Accordingly, skew (inclination) of an original document MS is corrected, and the original document MS is positioned correctly in the sheet conveyance direction.

The pullout drive roller 87 has a function of correcting skew of the original document MS, and further has a function of conveying the original document MS after skew correction to an intermediate roller pair 66 disposed downstream from the pullout drive roller 87 in the sheet conveyance direction. When the drive roller 82, the pullout drive roller 87, and the drive roller of the intermediate roller pair 66 wind and stretch the pickup roller 80 and the sheet feed belt 84 and are coupled to the sheet feeding motor 191 via respective one-way clutches. The one-way clutches coupled to the pullout drive roller 87 and the drive roller of the intermediate roller pair 66 transmit the driving force when the sheet feeding motor 191 rotates in the reverse direction. The one-way clutch coupled to the drive roller 82 transmits the driving force when the sheet feeding motor 191 rotates in the forward direction. For this reason, when the sheet feeding motor 191 rotates in the reverse direction, the pullout drive roller 87 and the drive roller of the intermediate roller pair 66 start rotating and the endless movement of the sheet feed belt 84 stops. At this time, the pickup roller 80 stops rotating.

The original document MS that is fed by the pullout drive roller 87 passes directly under the document width sensor 73. The document width sensor 73 includes multiple document detectors each including a reflective photosensor. The multiple document detectors are aligned in a row in the width direction of the original document MS (i.e., the direction orthogonal to the drawing sheet of FIG. 5). The size of the original document MS in the width direction is detected based on which one of the multiple document detectors detects the original document MS. The length of the original document MS in the sheet conveyance direction is detected based on the time from when the leading end of the original document MS is detected by the document contact sensor 72 to when the trailing end of the original document MS is not detected by the document contact sensor 72.

The leading end of the original document MS whose size in the width direction is detected by the document width sensor 73 enters the document turning part D and is nipped by the contact portion between the rollers of the intermediate roller pair 66. The conveyance speed of the original document MS conveyed by the intermediate roller pair 66 is set faster than the conveyance speed of the original document MS in the first reading and conveying part E that will be described below. This configuration achieves a reduction in time for entering the original document MS to the first reading and conveying part E.

The leading end of the original document MS conveyed in the document turning part D passes through a position where the leading end of the original document MS faces the scan entrance sensor 67. As a result, when the leading end of the original document MS is detected by the scan entrance sensor 67, the document conveyance speed of the original document MS by the intermediate roller pair 66 is reduced until the leading end of the original document MS is conveyed to the position of the scan entrance roller pair (including rollers 89 and 90) downstream from the scan entrance sensor 67 in the sheet conveyance direction. As the sheet conveyance motor 192 starts to drive and rotate, one roller of the scan entrance roller pair (including the rollers 89 and 90), one roller of a first scan exit roller pair 92, and one roller of a second scan exit roller pair 93 respectively start rotation.

In the document turning part D, while the original document MS is conveyed in the curved conveyance passage between the intermediate roller pair 66 and the scan entrance roller pair (including the rollers 89 and 90), the upper and lower faces of the original document MS are reversed, and the conveyance direction of the original document MS is turned back. Then, the leading end of the original document MS that has passed through the nip region between the rollers (89 and 90) of the scan entrance roller pair passes directly under the registration sensor 65. When the registration sensor 65 detects the leading end of the original document MS, the conveyance speed of the original document MS is gradually decreased through the given conveyance distance. Then, before the first reading and conveying part E, the conveyance of the original document MS is temporarily stopped. Further, a temporary stop signal is sent to the scanner controller 903 (see FIG. 7) via the I/F.

After receiving the temporary stop signal, the scanner controller 903 sends a scanning start signal, the ADF controller 904 controls the sheet conveyance motor 192 resumes rotating to increase the conveyance speed of the original document MS up to the given conveyance speed until the leading end of the original document MS reaches the first reading and conveying part E. Then, at the timing at which the leading end of the original document MS reaches the reading position of the first fixed reading unit 151, the ADF controller 904 sends a gate signal indicating an effective image area of the first face of the original document MS in the sub-scanning direction, to the scanner controller 903. The ADF controller 904 continues sending the gate signal to the scanner controller 903 until the trailing end of the original document MS passes through the reading position of the first fixed reading unit 151, so that the first face of the original document MS is scanned by the first fixed reading unit 151. The timing at which the leading end of the original document MS reaches the reading position of the first fixed reading unit 151 is calculated based on the pulse count of the sheet conveyance motor 192. A left ruler 156 is disposed at a light corner of the second exposure glass 155. When scanning an original document MS, the original document MS is placed on the second exposure glass 155 by contacting at the scale of the left ruler 156 before being scanned.

The original document MS that has passed through the first reading and conveying part E passes through the first scan exit roller pair 92, which will be described below. Then, the leading end of the original document MS is detected by the document ejection sensor 61. When the single-sided reading mode is set, the second face of the original document MS is not required to be read by the contact image sensor 95, which will be described below. As the leading end of the original document MS is detected by the document ejection sensor 61, the driving force of the sheet conveyance motor 192 is connected to a document ejection roller pair 94 by the sheet ejection clutch 194 to rotate the lower ejection roller in FIG. 5 of the document ejection roller pair 94 in the clockwise direction in FIG. 5. The timing at which the trailing end of the original document MS passes through the nip region of the document ejection roller pair 94 is calculated based on the pulse count of the sheet conveyance motor 192 after the detection of the leading end of the original document MS by the document ejection sensor 61. Then, based on this calculation result, the driving force of the sheet conveyance motor 192 is cut by the sheet ejection clutch 194 to stop the document ejection roller pair 94.

On the other hand, when the double-sided reading mode is set, the document ejection sensor 61 initially detects the leading end of the original document MS. Then, the timing at which the original document MS reaches the contact image sensor 95 is calculated based on the pulse count of the sheet conveyance motor 192. Then, at the timing at which the leading end of the original document MS reaches the contact image sensor 95, the ADF controller 904 sends a gate signal indicating the effective image area of the second face of the original document MS in the sub-scanning direction, to the scanner controller 903. The ADF controller 904 continues sending the gate signal to the scanner controller 903 until the trailing end of the original document MS passes through the reading position of the contact image sensor 95, so that the second face of the original document MS is scanned by the contact image sensor 95.

Then, the reading face of the contact image sensor 95 (CIS) serving as a second reader is coated for the purpose of preventing a reading vertical streak due to the paste-like foreign substance adhering to the original document MS adhering to the reading face of the contact image sensor 95. A reading roller 96 as a document supporter that supports the original document MS from a non-reading face side (i.e., the first face side) is disposed at a position facing the contact image sensor 95. The reading roller 96 serves as a floating retainer that prevents the original document MS from floating up at the reading position of the contact image sensor 95 and as a reference white portion for acquiring shading data in the contact image sensor 95. In the copier 500, the reading roller 96 is used as a document supporter that supports the original document MS at a position facing the contact image sensor 95. However, a member such as a guide plate may be used as a document supporter instead of the reading roller 96 having a roller shape.

Figure 8:
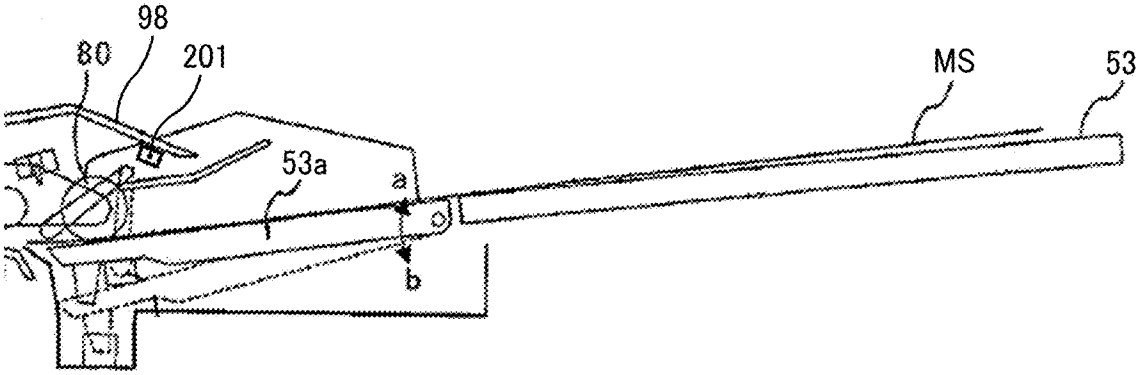
FIG. 8 is a diagram illustrating the position of a sound collection microphone.

FIG. 8 is a diagram illustrating the position of a sound collection microphone 201.

As illustrated in FIG. 8, the sound collection microphone 201 is attached on the inner circumferential face of a sheet feeder cover 98, and is disposed upstream from the pickup roller 80 in a document feeding direction. In the present embodiment, the sound collection microphone 201 is attached around the pickup roller 80 in order to collect the operating sounds of the sheet feeding and separating operation. The position of the sound collection microphone 201 is not limited to the above-described configuration. For example, a sound collection microphone may be disposed appropriately at a position where the operating sounds of the sheet feeding and separating operation can be collected preferably. As the sound collection microphone 201 is disposed on the inner circumferential face of the sheet feeder cover 98, noise from outside the ADF 51 can be shut down by the sheet feeder cover 98 and the sound collection microphone 201 is made difficult to pick up noise from outside of the ADF 51. The sheet feeding and separating operation is an operation from when the original documents MS on the movable document table 53*a* are fed out by the pickup roller 80 to when the separation roller 85 separates the uppermost original document MS from the other original documents MS fed out together with the uppermost original document MS.

When the original document MS is fed, the pickup roller 80 conveys the original document MS against a frictional force between the original document MS to be fed and an original document MS immediately below the original document MS or the movable document table 53*a*. Under such a condition, the original document MS may easily slip on the pickup roller 80. Due to such a slip on the pickup roller 80, the leading end of the original document MS does not reach the position of the document contact sensor 72 within a given time, the document contact sensor 72 detects a sheet jam indicating abnormal conveyance, and the conveyance of the original document MS is stopped. At the timing when this conveyance of the original document MS is stopped, the original document MS has already been conveyed for some extent in the ADF 51, which makes it difficult to remove the original document MS. As a result, the jammed original document MS may be wrinkled or torn when the jammed original document MS is removed from the ADF 51. Under such condition, the original document MS is likely to be damaged.

In addition, a bundle of original documents MS bound by metal pieces such as staples and clips may be set on the document loading tray 53 due to user's carelessness. When such a bundle of original documents MS thus bound is fed, it is likely that a paper jam occurs at the sheet separation portion that is the contact portion of the separation roller 85 and the sheet feed belt 84. Before the leading end of the original document MS is not detected by the document contact sensor 72 by a given timing and a paper jam is detected, the conveyance of the original document MS continues in a state where the paper jam occurs at the sheet separation portion.

As the leading end of the bundle of original documents MS bound by metal pieces such as staples and clips enter the sheet separation portion, the uppermost original document MS placed on top of the bundle of original documents MS is continuously conveyed by the sheet feed belt 84. However, the second and subsequent original documents receive a conveyance force by the separation roller 85 to return the second and subsequent original documents MS to the document loading tray 53. As a result, if the conveyance is continued even after the paper jam occurs at the sheet separation portion, a large stress is applied to the portions at which the bundle of original documents MS are bound by the metal piece. Due to such a large stress, the original documents MS are torn, bent, and wrinkled, and may be damaged.

For this reason, in the present embodiment, the abnormal conveyance determination is performed to determine whether a paper jam occurs as abnormal conveyance from the operating sound of the sheet feeding and separating operation collected by the sound collection microphone 201 (in other words, to predict whether the document contact sensor 72 detects a paper jam). When it is determined that a paper jam is likely to occur, the conveyance of the original documents MS is stopped. By so doing, the conveyance of the original document MS can be stopped at an early stage, the jammed original document MS can be easily removed, wrinkles and tears in the original document MS when removing the jammed original document MS can be prevented, and occurrence of damages on the original document MS can be reduced. Further, the conveyance of the original documents MS can be stopped before the bundle of original documents MS bound by metal pieces such as staples and clips enters the sheet separation portion or as soon as the bundle of original documents MS enters the sheet separation portion. Consequently, occurrence of serious damage on the original document MS can be reduced.

It is preferable that whether abnormal conveyance occurs is determined at a stage as early as possible from the start of sheet feeding by the pickup roller 80. By so doing, when it is determined that abnormal conveyance occurs, the conveyance of the original document MS can be stopped at an early stage. Accordingly, as the sheet feeder cover 98 is opened, the contact pressure between the pickup roller 80 and the original document MS is loosened, so that the original document MS can be easily removed. Further, when it is determined that abnormal conveyance occurs before the original document MS placed on the document loading tray 53 enters the sheet separation portion, conveyance of the original document MS can be stopped before the bundle of bound original documents MS enter the sheet separation portion. As a result, occurrence of damage on the original document MS can be preferably reduced.

However, if the abnormal conveyance is determined under a strict condition in an early stage and the conveyance of the original document is immediately stopped, the conveyance property of the ADF 51, in other words, the productivity of the ADF 51 is deteriorated.

On the other hand, in a case where determination of the abnormal conveyance in an early stage is made under a loose condition, in other words, a less strict condition, the conveyance of the original document that is determined as abnormal conveyance under a strict condition is not determined as abnormal conveyance and the conveyance of the original document is not stopped, even if the operating sound that requires an immediate stop of the conveyance of the original document is detected. In such a case, the following inconveniences are likely to occur. In other words, after the abnormal conveyance is determined, the original document may further cause another abnormal conveyance such as slipping of the original document or cause the abnormality in the original document in the document separating and feeding part B. When such an abnormality occurs, a conveying operation (idling) of the original document is performed for a given time or an original document is conveyed from the document separating and feeding part B until a paper jam is detected by, for example, the document contact sensor 72. While the abnormality occurs, the conveying operation of the original document is performed until the paper jam is detected by, for example, the document contact sensor 72. This operation causes a damage on the original document. Another inconvenience in which the original document MS is further damaged may occur when the original document MS is removed from the ADF 51.

In order to address this inconvenience, in the present embodiment, the abnormal conveyance determination is performed for multiple times during the conveyance of the original document.

Figure 9:
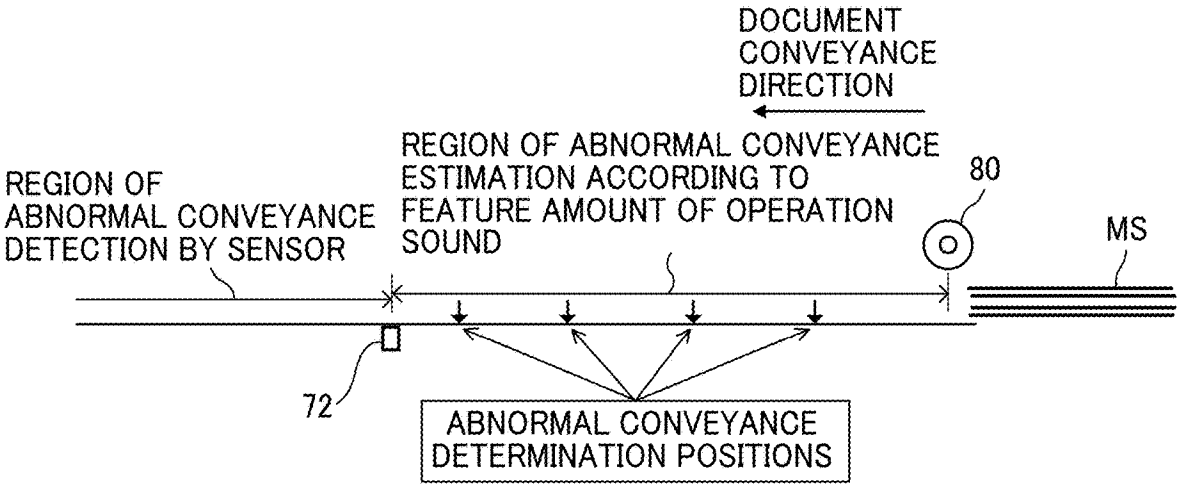
FIG. 9 is a diagram illustrating a timing of abnormal conveyance determination.

FIG. 9 is a diagram illustrating a timing of abnormal conveyance determination according to the present embodiment.

As illustrated in FIG. 9, in the present embodiment, a region from the contact position of the pickup roller 80 with the original document MS to the document contact sensor 72 serving as a sheet detector that detects a paper jam is an estimated abnormal conveyance region. The abnormal conveyance determination with the operating sound is performed for four times in the estimated abnormal conveyance region. Specifically, each determination of the abnormal conveyance is performed in the conveyance passage of the original document as illustrated in FIG. 9, at a timing at which the leading end of an original document passes the positions indicated by arrows at equal intervals in FIG. 9. The contact portion of the separation roller 85 and the sheet feed belt 84 is between the second determination position and the third determination position within the estimated abnormal conveyance region. However, in a case where abnormal conveyance such as a slip of the original document often occurs at the pickup roller 80, the third determination position or both the third determination position and the fourth determination position (i.e., the position at the final determination is performed) may be changed to the position or positions upstream from the contact portion in the sheet conveyance direction. Whether the leading end of the original document MS has passed the position indicated by arrows in FIG. 9 can be determined based on, for example, the number of driving pulses of the sheet feeding motor 191 and the time elapsed from the start of driving of the sheet feeding motor 191. In the document conveyance passage, the estimated abnormal conveyance region may be a region provided with a lower conveyance guide on the curved face of the document conveyance passage or may be a region provided with a lower conveyance guide on the flat face of the document conveyance passage.

By performing an abnormal conveyance determination is performed for multiple times as described above, the abnormal conveyance determination can be performed at both an early timing and a late timing. As a result, as an operation that leads to a serious, obvious abnormal conveyance occurs, the conveyance of the original document can be immediately stopped so as not to cause a paper jam in the document separating and feeding part B. In addition, as the abnormal conveyance can be estimated at a relatively early timing and is confirmed at a relatively late timing, the original document in an abnormal conveyance can be accurately stopped. As a result, as compared with a typical document conveying device in which an abnormal conveyance determination with the operating sound is performed only once, the abnormal conveyance can be estimated in an early stage, confirmed with good accuracy. By so doing, a damage on the original document MS can be forestalled, and occurrence of damage on the original document MS can be prevented.

In FIG. 9, the estimated abnormal conveyance region represents the region from the contact position of the pickup roller 80 with the original document MS to the document contact sensor 72 that detects a paper jam. However, the range of the estimated abnormal conveyance region is not limited to the above-described range.

For example, in a case where a multi-feeding detection sensor using ultrasound is disposed in the estimated abnormal conveyance region, at a position immediately downstream from the sheet separation portion, the estimated abnormal conveyance region may be from the contact position of the pickup roller 80 with the original document MS to the multi-feeding detection sensor.

Figure 10:
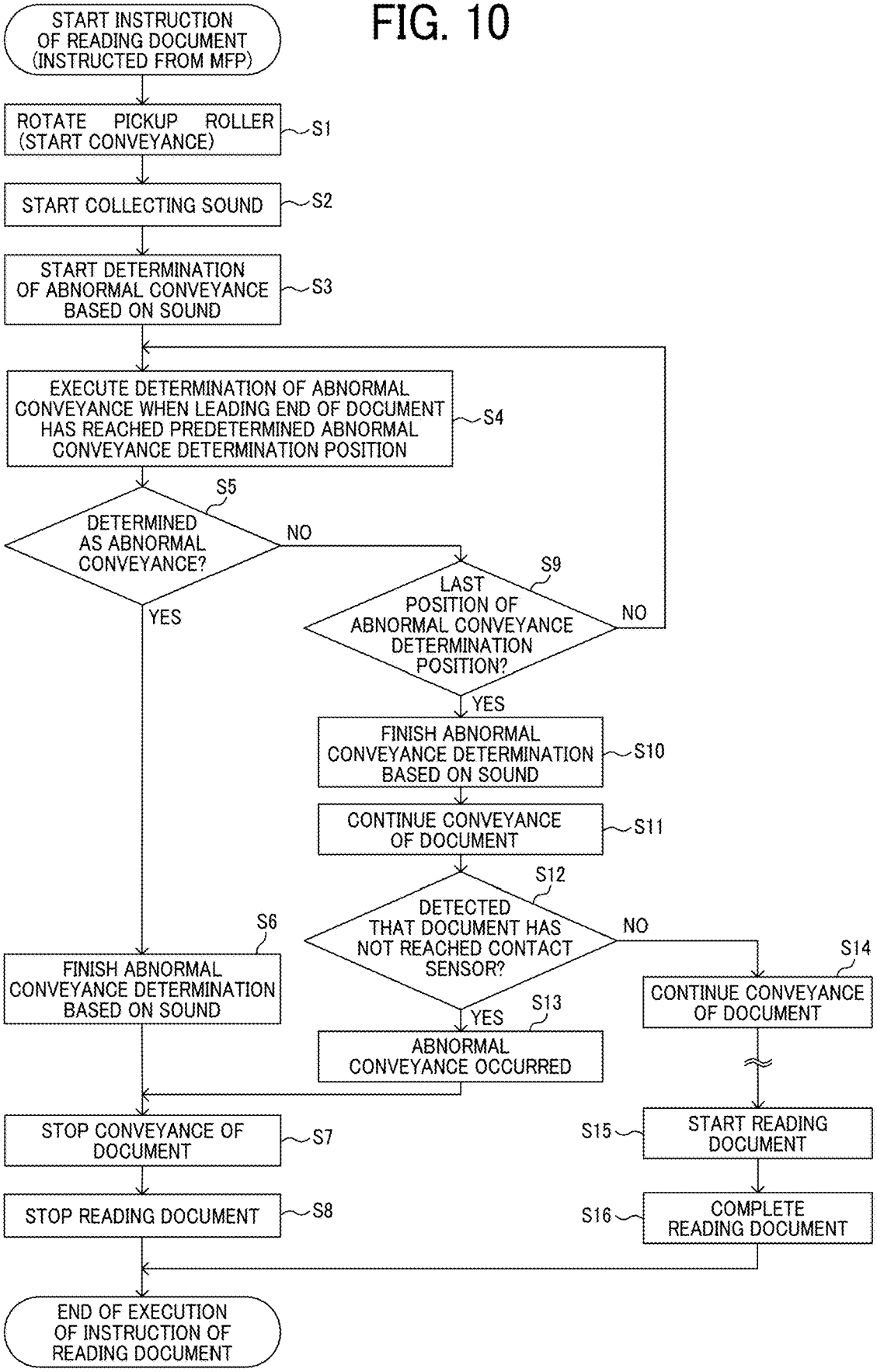
FIG. 10 is a flowchart of a process of abnormal conveyance determination.

FIG. 10 is a flowchart of a process of abnormal conveyance determination executed by the ADF controller 904.

Figure 11:
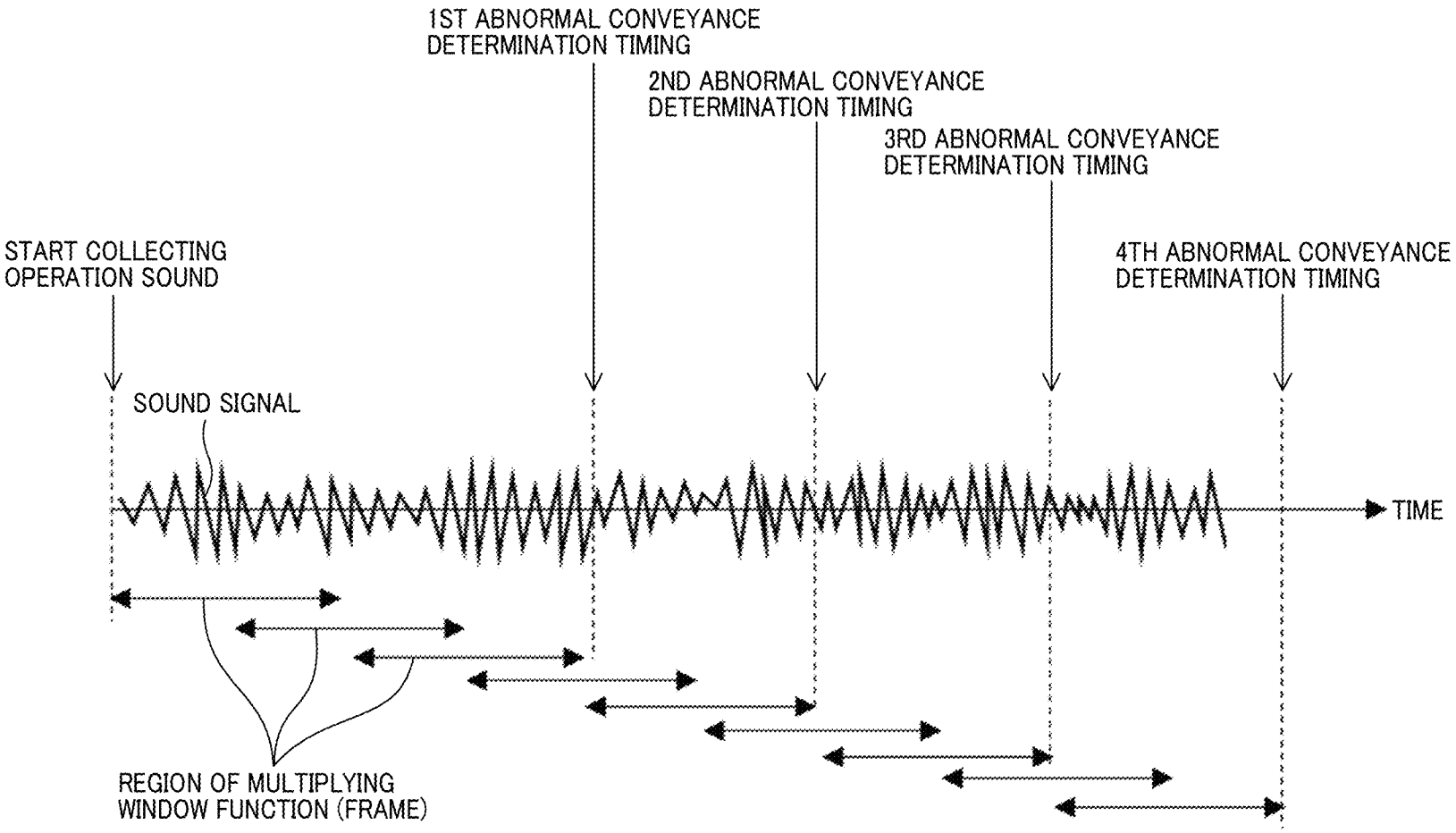
FIG. 11 is a diagram illustrating cutting of audio frame from an operating sound collected by the sound collection microphone.

Further, FIG. 11 is a diagram illustrating the audio frames cut out from an operating sound collected by the sound collection microphone 201.

As a document feeding signal is sent from the apparatus controller 901 to the ADF controller 904, the ADF controller 904 causes the sheet feeding motor 191 to rotate in the forward direction to rotate the pickup roller 80. The pickup roller 80 feeds the original document MS placed on the movable document table 53*a* to start the document conveyance (step S1). Simultaneously with the start of the document conveyance, the sound collection microphone 201 starts collecting operating sound (step S2). The audio signal of the operating sound collected by the sound collection microphone 201 is temporarily stored in the RAM of the ADF controller 904. The ADF controller 904 starts to perform the abnormal conveyance determination to determine whether abnormal conveyance occurs based on the collected operating sound (step S3).

After starting to perform the abnormal conveyance determination, the ADF controller 904 sequentially multiplies the audio signals of the operating sounds stored in the RAM by a window function as the window function slides, so that the audio signal is cut out to a frame having a given length. In the present embodiment, as illustrated in FIG. 11, a frame is cut out so as to partially overlap the previous frame. The short-time Fourier transform (STFT) is performed on the audio signal of the operating sound cut out into the frame to calculate the time sequence of the power spectrum of the audio signal.

The ADF controller 904 then perform a characterization process on the time sequence of the calculated power spectrum to calculate (extract) the feature amount of the operating sound. The characterization process may include, for example, time integration of power in a given frequency band and spectral flux between successive frames. In other words, in the present embodiment, the ADF controller 904 serves as a feature extraction unit. The feature that quantitatively describes the feature of the operating sound used for determining the operation condition is not limited to the above-described feature. For example, the feature may include known sound features such as Mel-Frequency Cepstral Coefficients.

Further, the ADF controller 904 executes the abnormal conveyance determination for four times in total at each timing at which the leading end of an original document reaches each of the abnormal conveyance determination positions illustrated in FIG. 9 (step S4). As the abnormal conveyance determination is executed, the ADF controller 904 determines the abnormal conveyance based on the feature amount of the operating sounds calculated by this timing.

In the present embodiment, the abnormal conveyance determination is executed by the Mahalanobis Taguchi (MT) method. The MT method is one of Mahalanobis-Taguchi (MT) system known for prediction, diagnosis and analysis based on multidimensional information data in the field of, for example, quality engineering. The MT method is one of methods that can determine whether the data is normal or abnormal by using the Mahalanobis distance, and is a method that can determine whether the condition is normal or abnormal in a simple manner and with relatively high accuracy. A detailed description of the MT method is omitted as the MT method is a publicly known method described in, for example, Japanese Patent Application Laid-Open No. 2003-141306.

As index data used for the abnormal conveyance determination, the following data is stored in advance in the read only memory (ROM) of the ADF controller 904. In other words, the data includes an inverse matrix R−1 of the correlation matrix of a unit space data set (i.e., the reference data set) used when calculating the Mahalanobis distance and a threshold Th as criteria for classifying the calculated Mahalanobis distance into normal conveyance or abnormal conveyance.

The inverse matrix R−1 is obtained by creating a unit space data set (i.e., reference data set) based on a feature amount obtained from an operating sound in which the original document MS is successfully conveyed (normal conveyance) under various erroneous factor conditions in the ADF 51. The threshold Th as criteria for determining whether the calculated Mahalanobis distance is normal conveyance and abnormal conveyance is set by obtaining a Mahalanobis distance at which a false negative rate (erroneous determination rate of normal conveyance) and a false positive rate (erroneous determination rate of abnormal conveyance) of the ADF 51 are respective target values.

As illustrated in FIG. 11, the feature amount of the operating sound used for determining the abnormal conveyance is three (3) at the first abnormal conveyance determination and five (5) at the second abnormal conveyance determination. At the fourth and final abnormal conveyance determination, the abnormal conveyance determination is executed based on the nine (9) feature amounts of the operating sound. Since the number of dimensions of the feature amounts of the operating sound to be input increases toward the later stages, the abnormal conveyance determination can be executed to change an estimation to a confirmation, with good accuracy in the later stages. Further, since the number of dimensions of the feature amounts of the operation sound to be input is different for each abnormal conveyance determination, the inverse matrix R−1 of the correlation matrix and the threshold Th are different for each abnormal conveyance determination and are stored in the ROM of the ADF controller 904 in association with the number of determinations of abnormal conveyance.

The threshold Th is set to a value that can be determined as normal with a margin with respect to a unit space dataset (i.e., a reference dataset) created under various erroneous factor conditions in the ADF 51. In other words, the threshold Th not to allow false negatives to some degree (i.e., erroneous determination to normal conveyance) but to hardly cause false positives (i.e., erroneous determination to abnormal conveyance) is set to determine whether the document conveyance is clearly an abnormal conveyance (i.e., abnormal document conveyance). In the present embodiment, since the abnormal conveyance determination is executed for multiple times, even if a certain degree of false negative (i.e., erroneous determination of the normal conveyance) is allowed, it is highly likely that any one of the abnormal conveyance determinations is determined to be positive (i.e., abnormal conveyance). For this reason, even if a certain degree of false negatives (i.e., erroneous determination of normal conveyance) is allowed, a paper jam can be preferably forestalled. Further, in a case where sound that clearly leads to abnormal conveyance is included in the collected operating sounds, the ADF controller 904 determines that abnormal conveyance occurs, and the conveyance of the original document can be stopped before the abnormal conveyance occurs. Due to such a configuration, occurrence of damage on an original document can be reduced.

Further, occurrence of abnormal conveyance is predictive in the first and second abnormal conveyance determinations in which the number of dimensions of the feature amounts of the operating sound to be input is relatively small and the accuracy is relatively low, and the threshold Th is set to a value that allows a certain degree of false negatives and hardly causes false positives (erroneous determination of abnormal conveyance). Furthermore, occurrence of abnormal conveyance is definite in the third and fourth abnormal conveyance determinations in which the number of dimensions of the feature amounts of the operating sound to be input is relatively large and the accuracy is relatively high, and the threshold Th may be set to a value having a low false negative rate and a low false positive rate.

Further, the threshold Th may be changed by a user. For example, multiple thresholds Th having different false positive rates and false negative rates are stored in the ROM of the ADF controller 904 for each of the four abnormal conveyance determinations. The user operates the apparatus control panel 902 of the image forming device 1 to select the threshold. For example, when paper jams (i.e., abnormal conveyance) are frequently detected by the document contact sensor 72, the user operates the apparatus control panel 902 to change the threshold Th to a threshold value Th with a low false negative rate (i.e., an erroneous determination rate of normal conveyance). Further, when abnormal conveyance determinations are frequently executed due to the abnormal conveyance determination of the operating sound, the user operates the apparatus control panel 902 to change the threshold Th to a threshold value Th with a low false negative rate (i.e., an erroneous determination rate of normal conveyance). Alternatively, a service person may operate the apparatus control panel 902 of the image forming device 1 to input a special command, so that the threshold Th can be changed.

In addition, for example, a "document damage control mode" may be provided, and when the user operates the apparatus control panel 902 to set the "document damage control mode", the threshold Th may be changed to a threshold value Th with a low false negative rate.

Since a user can change the threshold Th as described above, the strictness of abnormal conveyance determination according to the characteristics, installation environment, and purpose of the device can be preferably changed.

In addition, for example, the ADF controller 904 may grasp the detection rate of paper jam detected by the document contact sensor 72 and automatically change the threshold Th in accordance with the grasped detection rate of paper jam.

In step S5 of the flowchart in FIG. 10, the ADF controller 904 determines whether abnormal conveyance occurs. When the calculated Mahalanobis distance exceeds the threshold Th and the ADF controller 904 determines that abnormal conveyance occurs (YES in step S5), the ADF controller 904 finishes the abnormal conveyance determination based on the operating sound (step S6), stops the conveyance of the original document (step S7), stops reading the original document (step S8), and end the process of the flowchart. Then, the ADF controller 904 sends the result as a reading error to the apparatus control panel 902 of the image forming device 1 to display a message to, for example, prompt a paper jam handling.

On the other hand, when the calculated Mahalanobis distance is equal to or smaller than the threshold Th and the ADF controller 904 determines that the document conveyance is normal conveyance (NO in step S5), the ADF controller 904 determines whether the abnormal conveyance determination is the last (fourth) abnormal conveyance determination (step S9). In other words, the ADF controller 904 determines whether the position of the abnormal conveyance determination is the last position of the abnormal conveyance determination.

When the abnormal conveyance determination is not the last abnormal conveyance determination (NO in step S9), the ADF controller 904 executes the subsequent abnormal conveyance determination at the timing at which the leading end of the original document MS reaches the subsequent abnormal conveyance determination position (step S4). On the other hand, when the abnormal conveyance determination is the last abnormal conveyance determination (YES in step S9), the ADF controller 904 finishes the abnormal conveyance determination to determine the abnormal conveyance based on the operating sound for multiple times (step S10), and cause the document conveyance to continue step S11).

Then, the ADF controller 904 determines whether the document contact sensor 72 does not detect the leading end of the original document MS by a given time, in other words, whether the leading end of the original document MS has not reached the document contact sensor 72 (step S12). When the document contact sensor 72 detects the leading end of the original document MS by the given time (YES in step S12), the ADF controller 904 determines that the abnormal conveyance occurs in the document separating and feeding part B (step S13). When the ADF controller 904 determines that abnormal conveyance (i.e., a paper jam) occurs, the ADF controller 904 finishes the abnormal conveyance determination based on the operating sound (step S6), stops the conveyance of the original document (document conveyance) (step S7), stops reading the original document (step S8), and end the process of the flowchart. Then, the ADF controller 904 sends the result as a reading error to the apparatus control panel 902 of the image forming device 1 to display the message to prompt the paper jam handling.

On the other hand, when the document contact sensor 72 detects the leading end of the original document MS by the given time (NO in step S12), the ADF controller 904 causes the conveyance of the original document to continue (step S14). To be more specific, as described above, the ADF controller 904 causes the sheet feeding motor 191 to rotate in reverse, so that the pullout drive roller 87 pulls out the original document MS on which skew correction is performed. In other words, the ADF controller 904 performs a document pullout operation on the skew-corrected original document MS. Then, the ADF controller 904 causes the conveyance of the original document MS to temporarily stop before the first reading and conveying part E. In other words, the ADF controller 904 performs a temporary stop operation for temporarily stopping the conveyance of the original document MS before the original document MS enters the first reading and conveying part E. Then, the ADF controller 904 waits for a reading start signal to be sent from the scanner controller 903. In response to a receipt of the reading start signal from the scanner controller 903, the ADF controller 904 starts reading the original document (step S15). Then, the ADF controller 904 resumes the conveyance of the original document to convey the original document to the first reading and conveying part E and the second reading and conveying part F, so as to read the image on the original document. Then, as the original document is conveyed to the document ejecting part G, the ADF controller 904 causes the original document to be ejected to the ejection tray and completes the reading of the original document (step S16).

In the present embodiment, the abnormal conveyance determination is executed using the MT method. However, the abnormal conveyance determination may be executed by classifying the features of the operating sounds into normal conveyance and abnormal conveyance through machine learning of, for example, support-vector machines. Multiple learned models are obtained as a result of machine learning based on the learned model including the feature amounts calculated from the operating sounds to respective points of the abnormal conveyance determinations and determined data (i.e., normal conveyance or abnormal conveyance) and are stored in the ROM of the ADF controller 904. In abnormal conveyance determinations at respective points, the ADF controller 904 reads a corresponding learned model from the ROM, classifies the feature amounts of the operating sounds into normal conveyance and abnormal conveyance using the read learned model, and executes the abnormal conveyance determination.

In the above-described embodiment of the present disclosure, the abnormal conveyance determination is executed for four times, but the number of executions of abnormal conveyance determination may be appropriately determined depending on the configuration of the apparatus or device.

In the embodiments described above, the ADF 51 is described as a sheet conveying device that is applicable to the present disclosure. However, the configuration is not limited to the above-described configurations. For example, the present disclosure may be applied to a sheet conveying device that conveys a transfer sheet in the image forming device 1, where the sheet conveying device has a configuration in which operating sounds are collected in an area between the sheet feed rollers 43 and the sheet conveyance rollers 46, particularly, between the sheet feed rollers 43 and the registration roller pair 33 that serves as a pullout roller that can stop while the transfer sheet is being conveyed, at respective timings at which the leading end of a transfer sheet passes multiple given positions. The present disclosure may be also applied to the switchback device 36 and a sheet conveying device included in an inkjet image forming apparatus, where the sheet conveying device has a configuration in which operating sounds are collected.

The above-described embodiments are limited examples, and the present disclosure includes, for example, the following aspects having advantageous effects.

Aspect 1

In Aspect 1, a sheet conveying device (for example, the ADF 51) includes a conveyor (for example, the pickup roller 80), a sound collector (for example, the sound collection microphone 201), and circuitry (for example, the ADF controller 904). The conveyor conveys a sheet (for example, the original document MS). The sound collector collects an operating sound when the sheet is conveyed. The circuitry is to extract a feature amount of the operating sound collected by the sound collector, and determine, based on the feature amount, whether an abnormal conveyance of a sheet is to be occurred for multiple times until the sheet is conveyed to a given position. The feature amount in the present embodiment corresponds to the time integration of power in a frequency band and spectral flux between successive frames. The circuitry serves as the feature amount extractor and the abnormal conveyance determination unit.

Typically, the determination of the abnormal conveyance is performed only once by the time the sheet is conveyed to a given position. An early determination timing of abnormal conveyance is preferable so that the conveyance of the original document can be stopped before damage such as wrinkles occurs in the sheet. However, it is likely that such an early determination timing of the abnormal conveyance provides a less amount of data of the operating sounds and prevents determination with a good accuracy.

On the other hand, a late determination timing of abnormal conveyance provides a larger amount of data of the operating sounds and determination with a good accuracy can be executed. However, abnormal conveyance occurs before the determination of the abnormal conveyance and damage such as wrinkles is likely to occur in the sheet.

On the other hand, in Aspect 1, whether abnormal conveyance occurs is determined for multiple times before the sheet is conveyed to the given position. By so doing, abnormal conveyance can be determined at both an early timing and a late timing. Accordingly, when compared with a configuration in which abnormal conveyance is determined once, abnormal conveyance can be determined with a good accurately at an earlier stage, and can preferably prevent damage in a sheet.

Aspect 2

In Aspect 2, according to Aspect 1, the circuitry (for example, the ADF controller 904) is to sequentially cut the operating sound in a given time range from when a conveyance of the sheet (for example, the original document MS) starts to when the sheet is conveyed to the given position, extract the feature amount sequentially from the operating sound cut in the given time range, and determine whether the abnormal conveyance is to be occurred, based on the feature amount until the abnormal conveyance is determined.

According to this configuration, as described in the embodiments above, the dimensions of the feature amount to input increase as an abnormal conveyance is determined at the later stage. For this reason, the abnormal conveyance can be executed with good accuracy toward the later stage. Accordingly, occurrence of abnormal conveyance can be detected at an earlier stage, the conveyance of the sheets such as original documents, and occurrence of damages in the sheet can preferably be prevented.

Aspect 3

In Aspect 3, the sheet conveying device according to Aspect 1 or 2 further includes a sheet detector (for example, the document contact sensor 72) on a conveyance passage of the sheet (for example, the original document MS) to detect the sheet. The given position is a sheet detection position at which the sheet detector detects the sheet.

According to this configuration, as described in the embodiments above, the conveyance of the sheet (for example, the original document MS) can be stopped by the abnormal conveyance determination executed by the circuitry (for example, the ADF controller 904) before a paper jam is detected by the sheet detector (for example, the document contact sensor 72). Accordingly, occurrence of damage in the sheet can be preferably reduced or prevented.

Aspect 4

In Aspect 4, according to Aspect 3, the circuitry (for example, the ADF controller 904) is to determine the abnormal conveyance when the sheet detector (for example, the document contact sensor 72) does not detect the sheet (for example, the original document MS) by a given timing.

According to this configuration, the circuitry can surely detect abnormal conveyance.

Aspect 5

In Aspect 5, according to any one of Aspects 1 to 4, the circuitry (for example, the ADF controller 904) is to allow a user to change a criterion used to determine whether the abnormal conveyance is to be occurred based on the feature amount.

According to this configuration, as described in the embodiments above, the strictness of the abnormal conveyance determination can be changed in accordance with the installation environment of the apparatus the purpose of the user.

Aspect 6

In Aspect 6, according to any one of Aspect 1 to 5, the circuitry (for example, the ADF controller 904) is to determine that the abnormal conveyance is to be occurred, and stop a conveyance of the sheet (for example, the original document MS).

According to this configuration, as described in the embodiments above, the conveyance of the sheet (for example, the original document MS) can be stopped before a paper jam occurs, and any damage on the sheet can be forestalled.

Aspect 7

In Aspect 7, an automatic document feeder (for example, the ADF 51) includes the sheet conveying device (for example, the ADF 51) according to Aspect 1 to automatically convey a document sheet (for example, the original document MS) to an image reader (for example, the scanner 150).

According to this configuration, the sheet can be prevented from a paper jam or from being damaged, for example, being bent, wrinkled, or torn.

Aspect 8

In Aspect 8, an image forming apparatus (for example, the copier 500) includes the automatic document feeder (for example, the ADF 51) according to Aspect 7 to automatically convey an original document (for example, the original document MS) or the sheet conveying device (for example, the ADF 51) according to Aspect 1 to automatically convey an original document (for example, the original document MS), and an image former (for example, the image forming device 1) to form an image on the original document fed by the automatic document feeder.

According to this configuration, damage on a sheet or damage on an original document can be forestalled.

Aspect 9

In Aspect 9, a sheet conveying device (for example, the ADF 51) includes a conveyor a conveyor (for example, the pickup roller 80), a sound collector (for example, the sound collection microphone 201), and circuitry (for example, the ADF controller 904). The conveyor conveys a sheet (for example, the original document MS) in a sheet conveyance direction. The sound collector collects an operating sound generated by a conveyance of the sheet. The circuitry is to extract a feature amount of the operating sound collected by the sound collector, and determine, at different positions in the sheet conveyance direction based on the feature amount, whether an abnormal conveyance of the sheet occurs until the sheet is conveyed to a given position in the sheet conveyance direction.

Aspect 10

In Aspect 10, according to Aspect 9, the circuitry (for example, the ADF controller 904) is to sequentially cut the operating sound in a given time range from a start of the conveyance of the sheet to an arrival of the sheet (for example, the original document MS) at the given position, extract the feature amount sequentially from the operating sound cut in the given time range, and determine whether the abnormal conveyance occurs based on the feature amount.

Aspect 11

In Aspect 11, the sheet conveying device according to Aspect 9 or 10 further includes a sheet detector (for example, the document contact sensor 72) to detect the sheet at the given position.

Aspect 12

In Aspect 12, according to Aspect 11, the circuitry (for example, the ADF controller 904) determines that the abnormal conveyance occurs when the sheet detector (for example, the document contact sensor 72) does not detect the sheet by a given timing.

Aspect 13

In Aspect 13, according to any one of Aspects 9 to 12, a criterion used to determine whether the abnormal conveyance occurs based on the feature amount is variable.

Aspect 14

In Aspect 14, according to any one of Aspects 9 to 13, the circuitry (for example, the ADF controller 904) is to stop the conveyance of the sheet (for example, the original document MS) in response to a determination that the abnormal conveyance occurs.

Aspect 15

In Aspect 15, an automatic document feeder (for example, the ADF 51) includes the sheet conveying device (for example, the ADF 51) according to Aspect 9 to automatically convey a document sheet (for example, the original document MS) as the sheet to an image reader (for example, the scanner 150).

Aspect 16

In Aspect 16, an image forming apparatus (for example, the copier 500) includes the automatic document feeder (for example, the ADF 51) according to Aspect 15 to automatically convey an original document (for example, the original document MS), and an image reader (for example, the scanner 150) to read an image on the original document fed by the automatic document feeder.

Aspect 17

In Aspect 17, An image forming apparatus (for example, the copier 500) includes the sheet conveying device (for example, the ADF 51) according to Aspect 9 to convey the sheet (for example, the original document MS), and an image former (for example, the image forming device 1) to form an image on the sheet fed by the sheet conveying device.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a conveyor to convey a sheet in a sheet conveyance direction;

a sound collector to collect an operating sound generated by a conveyance of the sheet; and circuitry configured to:

extract a feature amount of the operating sound collected by the sound collector; and determine, at different positions in the sheet conveyance direction based on the feature amount, whether an abnormal conveyance of the sheet occurs until the sheet is conveyed to a given position in the sheet conveyance direction, wherein to extract the feature amount the circuitry is configured to:

sequentially cut the operating sound in a given time range from a start of the conveyance of the sheet to an arrival of the sheet at the given position, and extract the feature amount sequentially from the operating sound cut in the given time range; and the circuitry is configured to determine whether the abnormal conveyance occurs based on at least one threshold set as a criteria for classifying a distance of conveyance of the sheet as normal conveyance or abnormal conveyance, the threshold includes multiple thresholds based on a number of dimensions of plural feature amounts from a start of sound collection to determination of a corresponding abnormal conveyance, and false positive and false negative rates for the multiple thresholds are set lower as the number of dimensions of plural feature amounts increases.

2. The sheet conveying device according to claim 1, further comprising a sheet detector to detect the sheet at the given position.

3. The sheet conveying device according to claim 2, wherein the circuitry determines that the abnormal conveyance occurs when the sheet detector does not detect the sheet by a given timing.

4. The sheet conveying device according to claim 1, wherein a criterion used to determine whether the abnormal conveyance occurs based on the feature amount is variable.

5. The sheet conveying device according to claim 1, wherein the circuitry is configured to stop the conveyance of the sheet in response to a determination that the abnormal conveyance occurs.

6. An automatic document feeder comprising the sheet conveying device according to claim 1 to automatically convey a document sheet as the sheet to an image reader.

7. An image forming apparatus comprising:

the automatic document feeder according to claim 6 to automatically convey an original document; and an image reader to read an image on the original document fed by the automatic document feeder.

8. An image forming apparatus comprising:

the sheet conveying device according to claim 1 to convey the sheet; and an image former to form an image on the sheet fed by the sheet conveying device.

9. The sheet conveying device according to claim 1, wherein the circuitry is configured to:

classify the feature amount of the operating sound into normal conveyance, document deformation, or document slippage using a support-vector machine, and determine that the abnormal conveyance occurs when the feature amount is classified as document deformation or document slippage.

10. The sheet conveying device according to claim 1, wherein the sound collector is a microphone.

* * * * *